US006393851B1

(12) United States Patent
Wightman

(10) Patent No.: US 6,393,851 B1
(45) Date of Patent: May 28, 2002

(54) VAPOR COMPRESSION SYSTEM

(75) Inventor: David A. Wightman, Prospect Heights, IL (US)

(73) Assignee: XDX, LLC, Arlington Heights, IL (US)

( * ) Notice: Subject to any disclaimer, the term of this patent is extended or adjusted under 35 U.S.C. 154(b) by 0 days.

(21) Appl. No.: 09/661,543

(22) Filed: Sep. 14, 2000

(51) Int. Cl.[7] ..... F25B 41/04; F25B 5/00
(52) U.S. Cl. ..... 62/225; 62/117; 236/92 B
(58) Field of Search ..... 62/202, 217, 117, 62/225; 236/92 B, 228

(56) References Cited

U.S. PATENT DOCUMENTS

| | | | |
|---|---|---|---|
| 1,907,885 | A | 5/1933 | Shively |
| 2,084,755 | A | 6/1937 | Young, Jr. |
| 2,112,039 | A | 3/1938 | McLenegan |
| 2,126,364 | A | 8/1938 | Witzel |
| 2,164,761 | A | 7/1939 | Ashley |
| 2,200,118 | A | 5/1940 | Miller |
| 2,229,940 | A | 1/1941 | Spofford |
| 2,323,408 | A | 7/1943 | Miller |
| 2,467,519 | A | 4/1949 | Borghesan |
| 2,471,448 | A | 5/1949 | Platon |
| 2,511,565 | A | 6/1950 | Carter |
| 2,520,191 | A | 8/1950 | Aughey et al. |
| 2,539,062 | A | 1/1951 | Dillman |
| 2,547,070 | A | 4/1951 | Aughey et al. |
| 2,571,625 | A | 10/1951 | Seldon |

(List continued on next page.)

FOREIGN PATENT DOCUMENTS

| | | |
|---|---|---|
| DE | 197 52 259 A1 | 6/1998 |
| DE | 197 43 734 A1 | 4/1999 |
| EP | 0 355 180 A2 | 2/1990 |
| EP | 0355180 | 2/1990 |
| JP | 58146778 | 9/1983 |
| JP | 03020577 | 1/1991 |
| JP | 10325630 | 8/1998 |
| JP | 10306958 | 11/1998 |
| WO | WO 93/06422 | 4/1993 |
| WO | WO 95/03515 | 2/1995 |
| WO | WO 98/03827 | 1/1998 |
| WO | WO 98/57104 | 12/1998 |

OTHER PUBLICATIONS

Pending International Application No. PCT/US00/14648 entitled *Vapor Compression System and Method* International Filing Date: May 26, 2000 (our docket: 9713/14).
Pending U.S. application No. 09/661,478 entitled *Evaporator Coil With Multiple Orifices* filed Sep. 14, 2000 (our docket: 9713/15).
Pending U.S. application No. 09/661,477 entitled *Expansion Device For Vapor Compression System* filed Sep. 14, 2000 (our docket: 9713/16).
Pending U.S. application No. 09/228,696 entitled Vapor Compression System and Method filed Jan. 12, 1999 (our docket: 9713/3).
Pending U.S. application No. 09/431,830 entitled Vapor Compression System and Method filed Nov. 2, 1999 (our docket: 9713/4).

(List continued on next page.)

*Primary Examiner*—William Wayner
(74) *Attorney, Agent, or Firm*—Brinks Hofer Gilson & Lione

(57) ABSTRACT

A vapor compression system including a compressor, a condenser, an expansion valve, and an evaporator. The compressor increases the pressure and temperature of a heat transfer fluid. The condenser is connected with the compressor for liquefying the heat transfer fluid. The expansion valve is connected with the condenser and includes an expansion device for expanding the heat transfer fluid, and an internal sensor for detecting conditions within the heat transfer fluid. The evaporator is connected with the expansion valve for transferring heat from ambient surroundings to the heat transfer fluid.

6 Claims, 14 Drawing Sheets

U.S. PATENT DOCUMENTS

| | | | | |
|---|---|---|---|---|
| 2,596,036 | A | 5/1952 | MacDougall | |
| 2,707,868 | A | 5/1955 | Goodman | |
| 2,755,025 | A | 7/1956 | Boles | |
| 2,771,092 | A | 11/1956 | Schenk | |
| 2,856,759 | A | 10/1958 | Barbulesco | |
| 2,922,292 | A | 1/1960 | Lange | |
| 2,944,411 | A | 7/1960 | McGrath | |
| 2,960,845 | A | 11/1960 | Lange | 62/205 |
| 3,007,681 | A | 11/1961 | Keller | |
| 3,014,351 | A | 12/1961 | Leimbach | |
| 3,060,699 | A | 10/1962 | Tilney | |
| 3,138,007 | A | 6/1964 | Friedman et al. | |
| 3,150,498 | A | 9/1964 | Blake | |
| 3,194,499 | A | 7/1965 | Noakes et al. | |
| 3,257,822 | A | 6/1966 | Abbott | 62/428 |
| 3,316,731 | A | 5/1967 | Quick | |
| 3,343,375 | A | 9/1967 | Quick | |
| 3,392,542 | A | 7/1968 | Nussbaum | |
| 3,402,566 | A | 9/1968 | Leimbach | |
| 3,427,819 | A | 2/1969 | Seghetti | |
| 3,464,226 | A | 9/1969 | Kramer | |
| 3,520,147 | A | 7/1970 | Glackman | |
| 3,631,686 | A | 1/1972 | Kautz | |
| 3,633,378 | A | 1/1972 | Toth | |
| 3,638,444 | A | 2/1972 | Lindahl | |
| 3,638,447 | A | 2/1972 | Abe | |
| 3,683,637 | A | 8/1972 | Oshima et al. | |
| 3,708,998 | A | 1/1973 | Scherer et al. | |
| 3,727,423 | A | 4/1973 | Nielson | |
| 3,785,163 | A | 1/1974 | Wagner | |
| 3,792,594 | A | 2/1974 | Kramer | 62/503 |
| 3,798,920 | A | 3/1974 | Morgan | |
| 3,822,562 | A | 7/1974 | Crosby | |
| 3,866,427 | A | 2/1975 | Rothmayer et al. | |
| 3,921,413 | A | 11/1975 | Kohlbeck | |
| 3,934,424 | A | 1/1976 | Goldsberry | |
| 3,934,426 | A | 1/1976 | Jespersen et al. | |
| 3,948,060 | A | 4/1976 | Gaspard | |
| 3,965,693 | A * | 6/1976 | Widdowson | 62/217 |
| 3,967,466 | A | 7/1976 | Edwards | |
| 3,967,782 | A | 7/1976 | Eschbaugh et al. | |
| 3,968,660 | A | 7/1976 | Amann et al. | |
| 3,980,129 | A | 9/1976 | Bergdahl | |
| 4,003,729 | A | 1/1977 | McGrath | |
| 4,003,798 | A | 1/1977 | McCord | |
| 4,006,601 | A | 2/1977 | Ballarin et al. | |
| 4,103,508 | A | 8/1978 | Apple | |
| 4,106,691 | A | 8/1978 | Nielsen | |
| 4,122,686 | A | 10/1978 | Lindahl et al. | |
| 4,122,688 | A | 10/1978 | Mochizuki et al. | |
| 4,136,528 | A | 1/1979 | Vogel et al. | |
| 4,151,722 | A | 5/1979 | Willitts et al. | |
| 4,163,373 | A | 8/1979 | van der Sluijs | |
| 4,167,102 | A | 9/1979 | Willitts | |
| 4,176,525 | A | 12/1979 | Tucker et al. | |
| 4,182,133 | A | 1/1980 | Haas et al. | |
| 4,184,341 | A | 1/1980 | Friedman | |
| 4,193,270 | A | 3/1980 | Scott | |
| 4,207,749 | A | 6/1980 | Lavigne, Jr. | |
| 4,230,470 | A | 10/1980 | Matsuda et al. | |
| 4,235,079 | A | 11/1980 | Masser | |
| 4,270,362 | A | 6/1981 | Lancia et al. | |
| 4,285,205 | A | 8/1981 | Martin et al. | |
| 4,290,480 | A | 9/1981 | Sulkowski | |
| 4,302,945 | A | 12/1981 | Bell | |
| 4,328,682 | A | 5/1982 | Vana | |
| 4,350,021 | A | 9/1982 | Lundstrom | |
| 4,398,396 | A | 8/1983 | Schmerzler | |
| 4,430,866 | A | 2/1984 | Willitts | |
| 4,451,273 | A | 5/1984 | Cheng et al. | |
| 4,485,642 | A | 12/1984 | Karns | |
| 4,493,364 | A | 1/1985 | Macriss et al. | |
| 4,543,802 | A | 10/1985 | Ingelmann et al. | 62/525 |
| 4,583,582 | A | 4/1986 | Grossman | |
| 4,596,123 | A | 6/1986 | Cooperman | |
| 4,606,198 | A | 8/1986 | Latshaw et al. | 62/205 |
| 4,621,505 | A | 11/1986 | Ares et al. | |
| 4,633,681 | A | 1/1987 | Webber | |
| 4,658,596 | A | 4/1987 | Kuwahara | |
| 4,660,385 | A | 4/1987 | Macriss et al. | |
| 4,742,694 | A | 5/1988 | Yamanaka et al. | 62/210 |
| 4,779,425 | A | 10/1988 | Yoshihisa et al. | |
| 4,813,100 | A | 3/1989 | Umezu | |
| 4,848,100 | A | 7/1989 | Barthel et al. | |
| 4,852,364 | A | 8/1989 | Seener et al. | |
| 4,854,130 | A | 8/1989 | Naruse et al. | |
| 4,888,957 | A | 12/1989 | Chmielewski | |
| 4,938,032 | A | 7/1990 | Mudford | |
| 4,942,740 | A | 7/1990 | Shaw et al. | |
| 4,947,655 | A | 8/1990 | Shaw | |
| 4,955,205 | A | 9/1990 | Wilkinson | |
| 4,955,207 | A | 9/1990 | Mink | |
| 4,979,372 | A | 12/1990 | Tanaka | |
| 4,984,433 | A | 1/1991 | Worthington | |
| 5,050,393 | A | 9/1991 | Bryant | |
| 5,058,388 | A | 10/1991 | Shaw et al. | |
| 5,062,276 | A | 11/1991 | Dudley | |
| 5,065,591 | A | 11/1991 | Shaw | |
| 5,070,707 | A | 12/1991 | Ni | |
| 5,072,597 | A | 12/1991 | Bromley et al. | |
| 5,076,068 | A | 12/1991 | Mikhail | |
| 5,094,598 | A | 3/1992 | Amata et al. | |
| 5,107,906 | A | 4/1992 | Swenson et al. | |
| 5,129,234 | A | 7/1992 | Alford | |
| 5,131,237 | A | 7/1992 | Valbjorn | |
| 5,168,715 | A | 12/1992 | Nakao et al. | |
| 5,181,552 | A | 1/1993 | Eiermann | |
| 5,195,331 | A * | 3/1993 | Zimmern et al. | 62/202 |
| 5,231,845 | A | 8/1993 | Sumitani et al. | |
| 5,249,433 | A | 10/1993 | Hardison et al. | |
| 5,251,459 | A | 10/1993 | Grass et al. | |
| 5,253,482 | A | 10/1993 | Murway | |
| 5,291,941 | A | 3/1994 | Enomoto et al. | |
| 5,303,561 | A | 4/1994 | Bahel et al. | |
| 5,305,610 | A | 4/1994 | Bennett et al. | |
| 5,309,725 | A | 5/1994 | Cayce | |
| 5,329,781 | A | 7/1994 | Farrey et al. | |
| 5,355,323 | A | 10/1994 | Bae | |
| 5,377,498 | A | 1/1995 | Cur et al. | |
| 5,408,835 | A | 4/1995 | Anderson | |
| 5,423,480 | A | 6/1995 | Heffner et al. | |
| 5,440,894 | A | 8/1995 | Schaeffer et al. | |
| 5,509,272 | A | 4/1996 | Hyde | |
| 5,515,695 | A | 5/1996 | Sakakibara et al. | |
| 5,520,004 | A | 5/1996 | Jones, III | |
| 5,544,809 | A | 8/1996 | Keating et al. | |
| 5,586,441 | A | 12/1996 | Wilson et al. | |
| 5,597,117 | A | 1/1997 | Watanabe et al. | |
| 5,598,715 | A | 2/1997 | Edmisten | |
| 5,615,560 | A | 4/1997 | Inoue | |
| 5,622,055 | A | 4/1997 | Mei et al. | |
| 5,622,057 | A | 4/1997 | Bussjager et al. | |
| 5,634,355 | A | 6/1997 | Cheng et al. | |
| 5,651,258 | A | 7/1997 | Harris | |
| 5,678,417 | A | 10/1997 | Nigo et al. | |
| 5,689,962 | A | 11/1997 | Rafalovich | |
| 5,692,387 | A | 12/1997 | Alsenz et al. | |
| 5,694,782 | A | 12/1997 | Alsenz | |
| 5,706,665 | A | 1/1998 | Gregory | |
| 5,706,666 | A | 1/1998 | Yamanaka et al. | |
| 5,743,100 | A | 4/1998 | Welguisz et al. | |

| | | | | |
|---|---|---|---|---|
| 5,752,390 | A | 5/1998 | Hyde | |
| 5,765,391 | A | 6/1998 | Lee et al. | |
| 5,806,321 | A | 9/1998 | Bendtsen et al. | |
| 5,813,242 | A | 9/1998 | Lawrence et al. | |
| 5,826,438 | A | 10/1998 | Ohishi et al. | |
| 5,839,505 | A | 11/1998 | Ludwig et al. | 165/109.1 |
| 5,842,352 | A | 12/1998 | Gregory | |
| 5,845,511 | A | 12/1998 | Okada et al. | |
| 5,850,968 | A | 12/1998 | Jokinen | |
| 5,862,676 | A | 1/1999 | Kim et al. | |
| 5,867,998 | A | 2/1999 | Guertin | |
| 5,887,651 | A | 3/1999 | Meyer | 165/223 |
| 5,964,099 | A | 10/1999 | Kim | |
| 5,987,916 | A | 11/1999 | Egbert | |
| 6,318,118 | B2 | 11/2001 | Hanson et al. | 62/512 |

OTHER PUBLICATIONS

Pending U.S. application No. 09/443,071 entitled Vapor Compression System and Method filed Nov. 18, 1999 (our docket: 9713/5).

Pending U.S. International application No. PCT/US00/00622 entitled Vapor Compression System and Method International Filing Date: Jan. 10, 2000 (our docket: 9713/7).

Pending U.S. International application No. PCT/US00/00663 entitled Vapor Compression System and Method International Filing Date: Jan. 11, 2000 (our docket: 9713/8).

03304466; Hiroshi et al.; Air Conditioner; Nov. 15, 1990; Pub. No. 02–279966; p. 156.

02979575; Tadashi et al.; Refrigerating Cycle; Nov. 7, 1989; Pub. No. 01–277175; p. 46.

04001275; Tomomi et al.; Air Conditioner; Dec. 18, 1992; Pub. No. 04–366375; p. 69.

Kominkiewicz, Frank, Memo, dated Feb. 17, 2000, Subject "Tecogen Chiller", 6 pages.

Vienna–Tyler Dec. Case, Memo, dated Feb. 25, 2000, Compressor Model D6VD12, Ser. N159282.

* cited by examiner

VAPOR COMPRESSION SYSTEM

CROSS REFERENCE TO RELATED APPLICATIONS

Related subject matter is disclosed in commonly-owned, co-pending patent application entitled "VAPOR COMPRESSION SYSTEM AND METHOD" Ser. No. 09/228,696, filed on Jan. 12, 1999; "VAPOR COMPRESSION SYSTEM AND METHOD" Ser. No. 09/431,830, filed on Nov. 2, 1999; "VAPOR COMPRESSION SYSTEM AND METHOD" Ser. No. 09/443,071, filed on Nov. 18, 1999; PCT International patent application entitled "VAPOR COMPRESSION SYSTEM AND METHOD" PCT/US00/00663, filed on Jan. 11, 2000; and PCT International patent application entitled "VAPOR COMPRESSION SYSTEM AND METHOD FOR CONTROLLING CONDITIONS IN AMBIENT SURROUNDINGS" PCT/US00/14648, filed on May 26, 2000.

BACKGROUND

In a closed-loop vapor compression cycle, the heat transfer fluid changes state from a vapor to a liquid in the condenser, giving off heat, and changes state from a liquid to a vapor in the evaporator, absorbing heat during vaporization. A typical vapor-compression system includes a compressor for pumping a heat transfer fluid, such as a freon, to a condenser, where heat is given off as the vapor condenses into a liquid. The liquid flows through a liquid line to a thermostatic expansion valve, where the heat transfer fluid undergoes a volumetric expansion. The heat transfer fluid exiting the thermostatic expansion valve is a low quality liquid vapor mixture. As used herein, the term "low quality liquid vapor mixture" refers to a low pressure heat transfer fluid in a liquid state with a small presence of flash gas that cools off the remaining heat transfer fluid, as the heat transfer fluid continues on in a sub-cooled state. The expanded heat transfer fluid then flows into an evaporator, where the liquid refrigerant is vaporized at a low pressure absorbing heat while it undergoes a change of state from a liquid to a vapor. The heat transfer fluid, now in the vapor state, flows through a suction line back to the compressor. Sometimes, the heat transfer fluid exits the evaporator not in a vapor state, but rather in a superheated vapor state.

In one aspect, the efficiency of the vapor-compression cycle depends upon the ability of the vapor compression system to maintain the heat transfer fluid as a high pressure liquid upon exiting the condenser. The cooled, high-pressure liquid must remain in the liquid state over the long refrigerant lines extending between the condenser and the thermostatic expansion valve. The proper operation of the thermostatic expansion valve depends upon a certain volume of liquid heat transfer fluid passing through the valve. As the high-pressure liquid passes through an orifice in the thermostatic expansion valve, the fluid undergoes a pressure drop as the fluid expands through the valve. At the lower pressure, the fluid cools an additional amount as a small amount of flash gas forms and cools of the bulk of the heat transfer fluid that is in liquid form. As used herein, the term "flash gas" is used to describe the pressure drop in an expansion device, such as a thermostatic expansion valve, when some of the liquid passing through the valve is changed quickly to a gas and cools the remaining heat transfer fluid that is in liquid form to the corresponding temperature.

This low quality liquid vapor mixture passes into the initial portion of cooling coils within the evaporator. As the fluid progresses through the coils, it initially absorbs a small amount of heat while it warms and approaches the point where it becomes a high quality liquid vapor mixture. As used herein, the term "high quality liquid vapor mixture" refers to a heat transfer fluid that resides in both a liquid state and a vapor state with matched enthalpy, indicating the pressure and temperature of the heat transfer fluid are in correlation with each other. A high quality liquid vapor mixture is able to absorb heat very efficiently since it is in a change of state condition. The heat transfer fluid then absorbs heat from the ambient surroundings and begins to boil. The boiling process within the evaporator coils produces a saturated vapor within the coils that continues to absorb heat from the ambient surroundings. Once the fluid is completely boiled-off, it exits through the final stages of the cooling coil as a cold vapor. Once the fluid is completely converted to a cold vapor, it absorbs very little heat. During the final stages of the cooling coil, the heat transfer fluid enters a superheated vapor state and becomes a superheated vapor. As defined herein, the heat transfer fluid becomes a "superheated vapor" when minimal heat is added to the heat transfer fluid while in the vapor state, thus raising the temperature of the heat transfer fluid above the point at which it entered the vapor state while still maintaining a similar pressure. The superheated vapor is then returned through a suction line to the compressor, where the vapor-compression cycle continues.

For high-efficiency operation, the heat transfer fluid should change state from a liquid to a vapor in a large portion of the cooling coils within the evaporator. As the heat transfer fluid changes state from a liquid to a vapor, it absorbs a great deal of energy as the molecules change from a liquid to a gas absorbing a latent heat of vaporization. In contrast, relatively little heat is absorbed while the fluid is in the liquid state or while the fluid is in the vapor state. Thus, optimum cooling efficiency depends on precise control of the heat transfer fluid by the thermostatic expansion valve to insure that the fluid undergoes a change of state in as large of cooling coil length as possible. When the heat transfer fluid enters the evaporator in a cooled liquid state and exits the evaporator in a vapor state or a superheated vapor state, the cooling efficiency of the evaporator is lowered since a substantial portion of the evaporator contains fluid that is in a state which absorbs very little heat. For optimal cooling efficiency, a substantial portion, or an entire portion, of the evaporator should contain fluid that is in both a liquid state and a vapor state. To insure optimal cooling efficiency, the heat transfer fluid entering and exiting from the evaporator should be a high quality liquid vapor mixture.

The thermostatic expansion valve plays an important role and regulating the flow of heat transfer fluid through the closed-loop system. Before any cooling effect can be produced in the evaporator, the heat transfer fluid has to be cooled from the high-temperature liquid exiting the condenser to a range suitable of an evaporating temperature by a drop in pressure. The flow of low pressure liquid to the evaporator is metered by the thermostatic expansion valve in an attempt to maintain maximum cooling efficiency in the evaporator. Typically, once operation has stabilized, a mechanical thermostatic expansion valve regulates the flow of heat transfer fluid by monitoring the temperature of the heat transfer fluid in the suction line near the outlet of the evaporator. The heat transfer fluid upon exiting the thermostatic expansion valve is in the form of a low pressure liquid having a small amount of flash gas. The presence of flash gas provides a cooling affect upon the balance of the heat transfer fluid in its liquid state, thus creating a low quality liquid vapor mixture. A temperature sensor is attached to the suction line to measure the amount of superheating experienced by the heat transfer fluid as it exits from the evaporator. Superheat is the amount of heat added to the vapor, after the heat transfer fluid has completely boiled-off and liquid no longer remains in the suction line. Since very little heat is absorbed by the superheated vapor, the thermostatic expansion valve meters the flow of heat transfer fluid to minimize the amount of superheated vapor formed in the evaporator. Accordingly, the thermostatic expansion valve determines the amount of low-pressure liquid flowing into the evaporator by monitoring the degree of superheating of the vapor exiting from the evaporator.

In addition to the need to regulate the flow of heat transfer fluid through the closed-loop system, the optimum operating efficiency of the vapor compression system depends upon periodic defrost of the evaporator. Periodic defrosting of the evaporator is needed to remove icing that develops on the evaporator coils during operation. As ice or frost develops over the evaporator, it impedes the passage of air over the evaporator coils reducing the heat transfer efficiency. In a commercial system, such as a refrigerated display cabinet, the build up of frost can reduce the rate of air flow to such an extent that an air curtain cannot form in the display cabinet. In commercial systems, such as food chillers, and the like, it is often necessary to defrost the evaporator every few hours. Various defrosting methods exist, such as off-cycle methods, where the refrigeration cycle is stopped and the evaporator is defrosted by air at ambient temperatures. Additionally, electrical defrost off-cycle methods are used, where electrical heating elements are provided around the evaporator and electrical current is passed through the heating coils to melt the frost.

In addition to off-cycle defrost systems, vapor compression systems have been developed that rely on the relatively high temperature of the heat transfer fluid exiting the compressor to defrost the evaporator. In these techniques, the high-temperature vapor is routed directly from the compressor to the evaporator. In one technique, the flow of high temperature vapor is dumped into the suction line and the vapor compression system is essentially operated in reverse. In other techniques, the high-temperature vapor is pumped into a dedicated line that leads directly from the compressor to the evaporator for the sole purpose of conveying high-temperature vapor to periodically defrost the evaporator. Additionally, other complex methods have been developed that rely on numerous devices within the vapor compression system, such as bypass valves, bypass lines, heat exchangers, and the like.

In an attempt to obtain better operating efficiency from conventional vapor-compression systems, the refrigeration industry is developing systems of growing complexity. Sophisticated computer-controlled thermostatic expansion valves have been developed in an attempt to obtain better control of the heat transfer fluid through the evaporator. Additionally, complex valves and piping systems have been developed to more rapidly defrost the evaporator in order to maintain high heat transfer rates. While these systems have achieved varying levels of success, the vapor compression system cost rises dramatically as the complexity of the vapor compression system increases. Accordingly, a need exists for an efficient vapor compression system that can be installed at low cost and operated at high efficiency.

BRIEF SUMMARY

According to a first aspect of the present invention, a vapor compression system is provided that maintains high operating efficiency by feeding a saturated vapor into the inlet of an evaporator. As used herein, the term "saturated vapor" refers to a heat transfer fluid that resides in both a liquid state and a vapor state with matched enthalpy, indicating the pressure and temperature of the heat transfer fluid are in correlation with each other. Saturated vapor is a high quality liquid vapor mixture. By feeding saturated vapor to the evaporator, heat transfer fluid in both a liquid and a vapor state enters the evaporator coils. Thus, the heat transfer fluid is delivered to the evaporator in a physical state in which maximum heat can be absorbed by the fluid. In addition to high efficiency operation of the evaporator, in one preferred embodiment of the invention, the vapor compression system provides a simple means of defrosting the evaporator. A multifunctional valve is employed that contains separate passageways feeding into a common chamber. In operation, the multifunctional valve can transfer either a saturated vapor, for cooling, or a high temperature vapor, for defrosting, to the evaporator.

In one form, the vapor compression system includes an evaporator for evaporating a heat transfer fluid, a compressor for compressing the heat transfer fluid to a relatively high temperature and pressure, and a condenser for condensing the heat transfer fluid. A saturated vapor line is coupled from an expansion valve to the evaporator. In one aspect of the invention, the diameter and the length of the saturated vapor line is sufficient to insure substantial conversion of the heat transfer fluid into a saturated vapor prior to delivery of the fluid to the evaporator. In one preferred embodiment of the invention, a heat source is applied to the heat transfer fluid in the saturated vapor line sufficient to vaporize a portion of the heat transfer fluid before the heat transfer fluid enters the evaporator. In one aspect of the invention, a heat source is applied to the heat transfer fluid after the heat transfer fluid passes through the expansion valve and before the heat transfer fluid enters the evaporator. The heat source converts the heat transfer fluid from a low quality liquid vapor mixture to a high quality liquid vapor mixture, or a saturated vapor. Typically, at least about 5% of the heat transfer fluid is vaporized before entering the evaporator.

In one embodiment of the invention, the expansion valve resides within a multifunctional valve that includes a first inlet for receiving the heat transfer fluid in the liquid state, and a second inlet for receiving the heat transfer fluid in the vapor state. The multifunctional valve further includes passageways coupling the first and second inlets to a common chamber. Gate valves positioned within the passageways enable the flow of heat transfer fluid to be independently interrupted in each passageway. The ability to independently control the flow of saturated vapor and high temperature vapor through the vapor compression system produces high operating efficiency by both increased heat transfer rates at the evaporator and by rapid defrosting of the evaporator. The increased operating efficiency enables the vapor compression system to be charged with relatively small amounts of heat transfer fluid, yet the vapor compression system can handle relatively large thermal loads.

In yet another embodiment, heat transfer fluid enters the common chamber of the multifunctional valve as a liquid vapor mixture and generally follows a flow direction. By controlling the flow rate of the heat transfer fluid and the shape of the common chamber, its is possible to separate a substantial amount of the liquid vapor mixture into liquid and vapor so that heat transfer fluid exists the common chamber through an outlet as liquid and vapor, wherein a substantial amount of the liquid is separate and apart from a substantial amount of the vapor.

In one preferred embodiment, the vapor compression system includes a compressor, a condenser, an evaporator, an XDX valve, and an expansion valve. In accordance with this embodiment, the flow of heat transfer fluid from the condenser to the evaporator can be switched to go through either the XDX valve or the expansion valve. Preferably, the vapor compression system includes a sensor that measures the conditions of ambient surroundings, that is, the area or space in which the conditions such as temperature and humidity are controlled or altered by vapor compression system. Upon determining the conditions of the ambient surroundings, the sensor then decides whether to direct the flow of heat transfer fluid to either the XDX valve or the expansion valve.

DETAILED DESCRIPTION OF THE PREFERRED EMBODIMENTS

Figure 1:
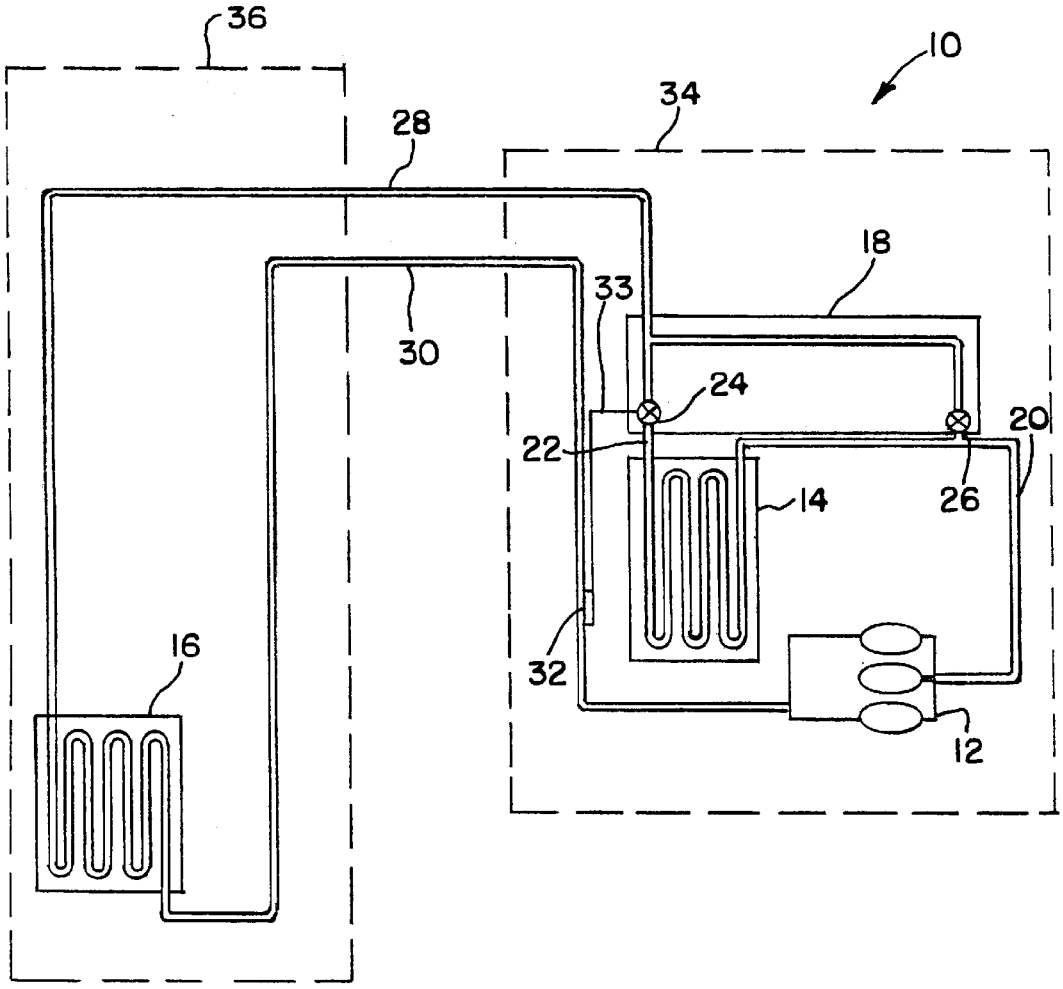
FIG. 1 is a schematic drawing of a vapor-compression system arranged in accordance with one embodiment of the invention.

An embodiment of a vapor-compression system 10 arranged in accordance with one embodiment of the invention is illustrated in FIG. 1. Vapor compression system 10 includes a compressor 12, a condenser 14, an evaporator 16, and a multifunctional valve 18. Compressor 12 is coupled to condenser 14 by a discharge line 20. Multifunctional valve 18 is coupled to condenser 14 by a liquid line coupled to a first inlet 24 of multifunctional valve 18. Additionally, multifunctional valve 18 is coupled to discharge line 20 at a second inlet 26. A saturated vapor line 28 couples multifunctional valve 18 to evaporator 16, and a suction line 30 couples the outlet of evaporator 16 to the inlet of compressor 12. A temperature sensor 32 is mounted to suction line 30 and is operably connected to multifunctional valve 18. In accordance with the invention, compressor 12, condenser 14, multifunctional valve 18 and temperature sensor 32 are located within a control unit 34. Correspondingly, evaporator 16 is located within a refrigeration case 36. In one preferred embodiment of the invention, compressor 12, condenser 14, multifunctional valve 18, temperature sensor 32 and evaporator 16 are all located within a refrigeration case 36. In another preferred embodiment of the invention, the vapor compression system comprises control unit 34 and refrigeration case 36, wherein compressor 12 and condenser 14 are located within the control unit 34, and wherein evaporator 16, multifunctional valve 18, and temperature sensor 32 are located within refrigeration case 36.

The vapor compression system of the present invention can utilize essentially any commercially available heat transfer fluid including refrigerants such as, for example, chlorofluorocarbons such as R-12 which is a dicholordifluoromethane, R-22 which is a monochlorodifluoromethane, R-500 which is an azeotropic refrigerant consisting of R-12 and R-152*a*, R-503 which is an azeotropic refrigerant consisting of R-23 and R-13, and R-502 which is an azeotropic refrigerant consisting of R-22 and R-115. The vapor compression system of the present invention can also utilize refrigerants such as, but not limited to refrigerants R-13, R-113, 141*b*, 123*a*, 123, R-114, and R-11. Additionally, the vapor compression system of the present invention can utilize refrigerants such as, for example, hydrochlorofluorocarbons such as 141*b*, 123*a*, 123, and 124, hydrofluorocarbons such as R-134*a*, 134, 152, 143*a*, 125, 32, 23, and azeotropic HFCs such as AZ-20 and AZ-50 (which is commonly known as R-507). Blended refrigerants such as MP-39, HP-80, FC-14, R-717, and HP-62 (commonly known as R-404*a*), may also be used as refrigerants in the vapor compression system of the present invention. Accordingly, it should be appreciated that the particular refrigerant or combination of refrigerants utilized in the present invention is not deemed to be critical to the operation of the present invention since this invention is expected to operate with a greater system efficiency with virtually all refrigerants than is achievable by any previously known vapor compression system utilizing the same refrigerant.

In operation, compressor 12 compresses the heat transfer fluid, to a relatively high pressure and temperature. The temperature and pressure to which the heat transfer fluid is compressed by compressor 12 will depend upon the particular size of vapor compression system 10 and the cooling load requirements of the vapor compression system. Compressor 12 pumps the heat transfer fluid into discharge line 20 and into condenser 14. As will be described in more detail below, during cooling operations, second inlet 26 is closed and the entire output of compressor 12 is pumped through condenser 14.

In condenser 14, a medium such as air, water, or a secondary refrigerant is blown past coils within condenser 14 causing the pressurized heat transfer fluid to change to the liquid state. The temperature of the heat transfer fluid drops about 10 to 40° F. (5.6 to 22.2° C.), depending on the particular heat transfer fluid, or glycol, or the like, as the latent heat within the fluid is expelled during the condensation process. Condenser 14 discharges the liquefied heat transfer fluid to liquid line 22. As shown in FIG. 1, liquid line 22 immediately discharges into multifunctional valve 18. Because liquid line 22 is relatively short, the pressurized liquid carried by liquid line 22 does not substantially increase in temperature as it passes from condenser 14 to multifunctional valve 18. By configuring vapor compression system 10 to have a short liquid line 22, vapor compression system 10 advantageously delivers substantial amounts of heat transfer fluid to multifunctional valve 18 at a low temperature and high pressure. Since the heat transfer fluid does not travel a great distance once it is converted to a high-pressure liquid, little heat absorbing capability is lost by the inadvertent warming of the liquid before it enters multifunctional valve 18, or by a loss in liquid pressure. While in the above embodiments of the invention, the vapor compression system uses a relatively short liquid line 22, it is possible to implement the advantages of the present invention in a vapor compression system using a relatively long liquid line 22, as will be described below. The heat transfer fluid discharged by condenser 14 enters multifunctional valve 18 at first inlet 24 and undergoes a volumetric expansion at a rate determined by the temperature of suction line 30 at temperature sensor 32. Multifunctional valve 18 discharges the heat transfer fluid as a saturated vapor into saturated vapor line 28. Temperature sensor 32 relays temperature information through a control line 33 to multifunctional valve 18.

Those skilled in the art will recognize that vapor compression system 10 can be used in a wide variety of applications for controlling the temperature of an enclosure, such as a refrigeration case in which perishable food items are stored. For example, where vapor compression system 10 is employed to control the temperature of a refrigeration case having a cooling load of about 12000 Btu/hr (84 g cal/s), compressor 12 discharges about 3 to 5 lbs/min (1.36 to 2.27 kg/min) of R-12 at a temperature of about 110° F. (43.3° C.) to about 120° F. (48.9° C.) and a pressure of about 150 lbs/in$^2$ (1.03 E5 N/m$^2$) to about 180 lbs/in.$^2$ (1.25 E5 N/m$^2$)

In accordance with one preferred embodiment of the invention, saturated vapor line 28 is sized in such a way that the low pressure fluid discharged into saturated vapor line 28 substantially converts to a saturated vapor as it travels through saturated vapor line 28. In one embodiment, saturated vapor line 28 is sized to handle about 2500 ft/min (76 m/min) to 3700 ft/min (1128 m/min) of a heat transfer fluid, such as R-12, and the like, and has a diameter of about 0.5 to 1.0 inches (1.27 to 2.54 cm), and a length of about 90 to 100 feet (27 to 30.5 m). As described in more detail below, multifunctional valve 18 includes a common chamber immediately before the outlet. The heat transfer fluid undergoes an additional volumetric expansion as it enters the common chamber. The additional volumetric expansion of the heat transfer fluid in the common chamber of multifunctional valve 18 is equivalent to an effective increase in the line size of saturated vapor line 28 by about 225%.

Those skilled in the art will further recognize that the positioning of a valve for volumetrically expanding of the heat transfer fluid in close proximity to the condenser, and the relatively great length of the fluid line between the point of volumetric expansion and the evaporator, differs considerably from systems of the prior art. In a typical prior art system, an expansion valve is positioned immediately adjacent to the inlet of the evaporator, and if a temperature sensing device is used, the device is mounted in close proximity to the outlet of the evaporator. As previously described, such system can suffer from poor efficiency because substantial amounts of the evaporator carry a liquid rather than a saturated vapor. Fluctuations in high side pressure, liquid temperature, heat load or other conditions can adversely effect the evaporator's efficiency.

In contrast to the prior art, the inventive vapor compression system described herein positions a saturated vapor line between the point of volumetric expansion and the inlet of the evaporator, such that portions of the heat transfer fluid are converted to a saturated vapor before the heat transfer fluid enters the evaporator. By charging evaporator 16 with a saturated vapor, the cooling efficiency is greatly increased. By increasing the cooling efficiency of an evaporator, such as evaporator 16, numerous benefits are realized by the vapor compression system. For example, less heat transfer fluid is needed to control the air temperature of refrigeration case 36 at a desired level. Additionally, less electricity is needed to power compressor 12 resulting in lower operating cost. Further, compressor 12 can be sized smaller than a prior art system operating to handle a similar cooling load. Moreover, in one preferred embodiment of the invention, the vapor compression system avoids placing numerous components in proximity to the evaporator. By restricting the placement of components within refrigeration case 36 to a minimal number, the thermal loading of refrigeration case 36 is minimized.

Figure 7:
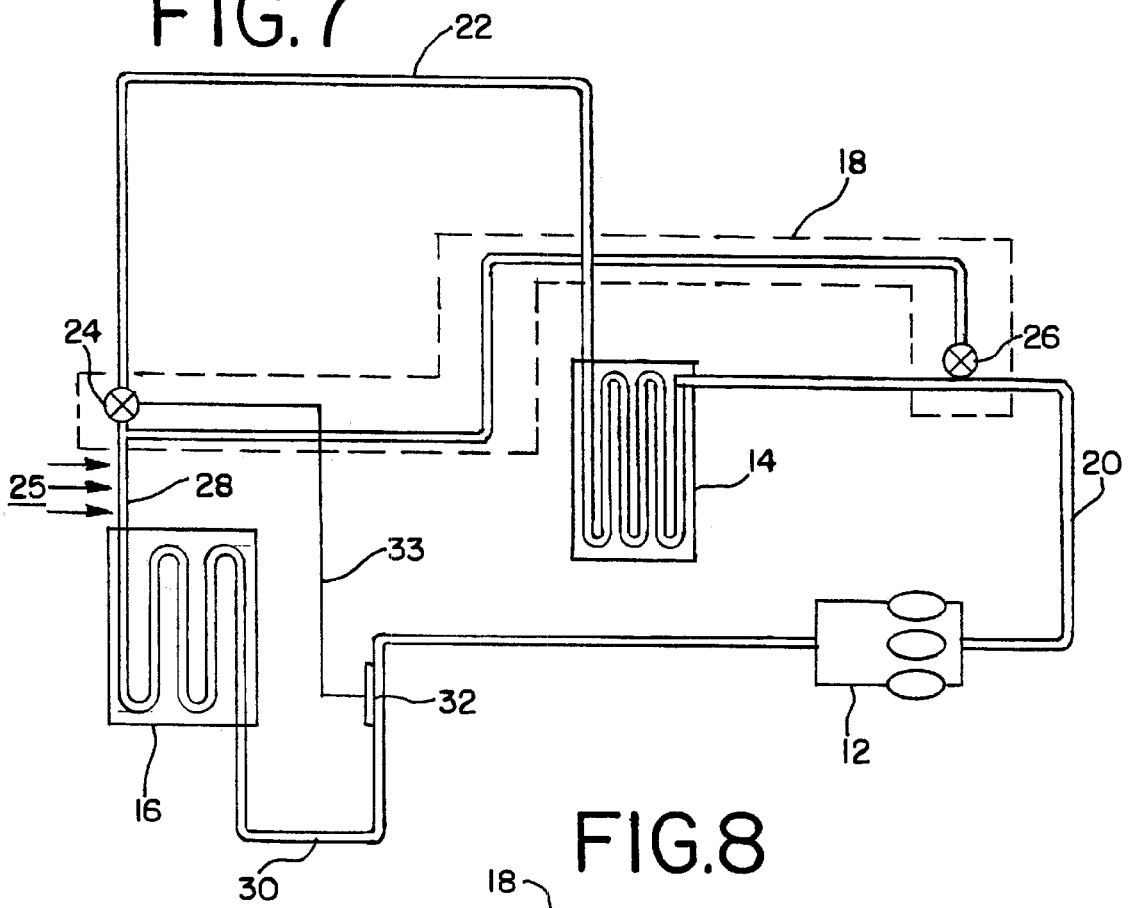
FIG. 7 is a schematic view of a vapor-compression system in accordance with yet another embodiment of the invention.
Figure 8:
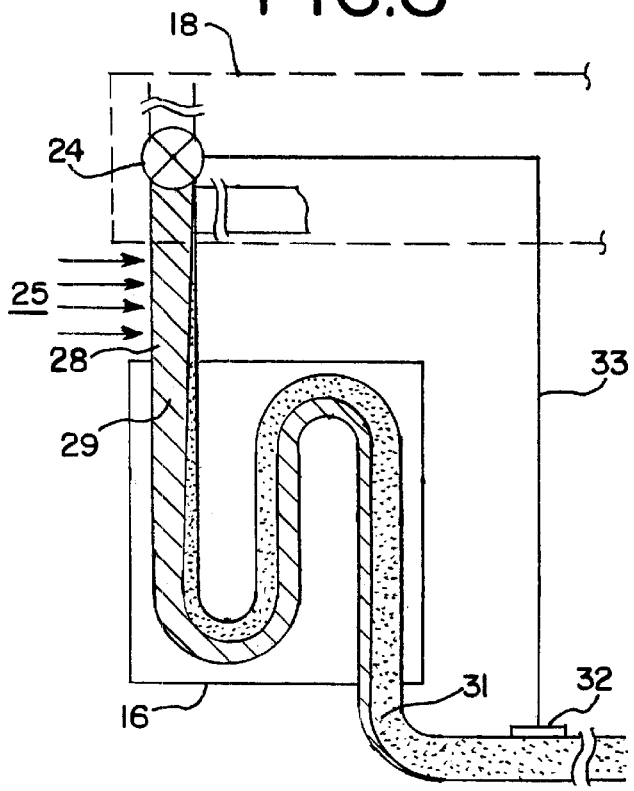
FIG. 8 is an enlarged cross-sectional view of a portion of the vapor compression system illustrated in FIG. 7.

While in the above embodiments of the invention, multifunctional valve 18 is positioned in close proximity to condenser 14, thus creating a relatively short liquid line 22 and a relatively long saturated vapor line 28, it is possible to implement the advantages of the present invention even if multifunctional valve 18 is positioned immediately adjacent to the inlet of the evaporator 16, thus creating a relatively long liquid line 22 and a relatively short saturated vapor line 28. For example, in one preferred embodiment of the invention, multifunctional valve 18 is positioned immediately adjacent to the inlet of the evaporator 16, thus creating a relatively long liquid line 22 and a relatively short saturated vapor line 28, as illustrated in FIG. 7. In order to insure that the heat transfer fluid entering evaporator 16 is a saturated vapor, a heat source 25 is applied to saturated vapor line 28, as illustrated in FIGS. 7–8. Temperature sensor 32 is mounted to suction line 30 and operatively connected to multifunctional valve 18, wherein heat source 25 is of sufficient intensity so as to vaporize a portion of the heat transfer fluid before the heat transfer fluid enters evaporator 16. The heat transfer fluid entering evaporator 16 is converted to a saturated vapor wherein a portion of the heat transfer fluids exists in a liquid state 29, and another portion of the heat transfer fluid exists in a vapor state 31, as illustrated in FIG. 8.

Preferably heat source 25 used to vaporize a portion of the heat transfer fluid comprises heat transferred to the ambient surroundings from condenser 14, however, heat source 25 can comprise any external or internal source of heat known to one of ordinary skill in the art, such as, for example, heat transferred to the ambient surroundings from the discharge line 20, heat transferred to the ambient surroundings from a compressor, heat generated by a compressor, heat generated from an electrical heat source, heat generated using combustible materials, heat generated using solar energy, or any other source of heat. Heat source 25 can also comprise an active heat source, that is, any heat source that is intentionally applied to a part of vapor compression system 10, such as saturated vapor line 28. An active heat source includes but is not limited to a source of heat such as heat generated from an electrical heat source, heat generated using combustible materials, heat generated using solar energy, or any other source of heat which is intentionally and actively applied to any part of vapor compression system 10. A heat source that comprises heat which accidentally leaks into any part of vapor compression system 10 or heat which is unintentionally or unknowingly absorbed into any part of vapor compression system 10, either due to poor insulation or other reasons, is not an active heat source.

In one preferred embodiment of the invention, temperature sensor 32 monitors the heat transfer fluid exiting evaporator 16 in order to insure that a portion of the heat transfer fluid is in a liquid state 29 upon exiting evaporator 16, as illustrated in FIG. 8. In one preferred embodiment of the invention, at least about 5% of the of the heat transfer fluid is vaporized before the heat transfer fluid enters the evaporator, and at least about 1% of the heat transfer fluid is in a liquid state upon exiting the evaporator. By insuring that a portion of the heat transfer fluid is in liquid state 29 and vapor state 31 upon entering and exiting the evaporator, the vapor compression system of the present invention allows evaporator 16 to operate with maximum efficiency. In one preferred embodiment of the invention, the heat transfer fluid is in at least about a 1% superheated state upon exiting evaporator 16. In one preferred embodiment of the invention, the heat transfer fluid is between about a 1% liquid state and about a 1% superheated vapor state upon exiting evaporator 16.

While the above embodiments rely on heat source 25 or the dimensions and length of saturated vapor line 28 to insure that the heat transfer fluid enters the evaporator 16 as a saturated vapor, any means known to one of ordinary skill in the art which can convert the heat transfer fluid to a saturated vapor upon entering evaporator 16 can be used. Additionally, while the above embodiments use temperature sensor 32 to monitor the state of the heat transfer fluid exiting the evaporator, any metering device known to one of ordinary skill in the art which can determine the state of the heat transfer fluid upon exiting the evaporator can be used, such as a pressure sensor, or a sensor which measures the density of the fluid. Additionally, while in the above embodiments, the metering device monitors the state of the heat transfer fluid exiting evaporator 16, the metering device can also be placed at any point in or around evaporator 16 to monitor the state of the heat transfer fluid at any point in or around evaporator 16.

Figure 2:
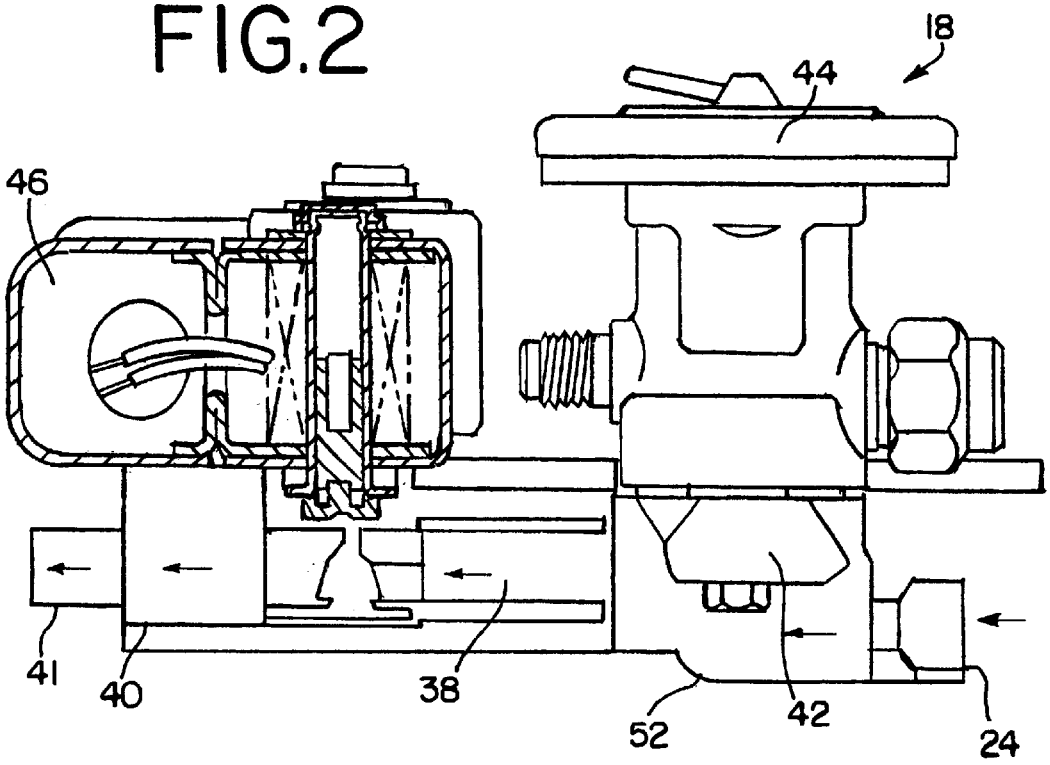
FIG. 2 is a side view, in partial cross-section, of a first side of a multifunctional valve in accordance with one embodiment of the invention.
Figure 21:
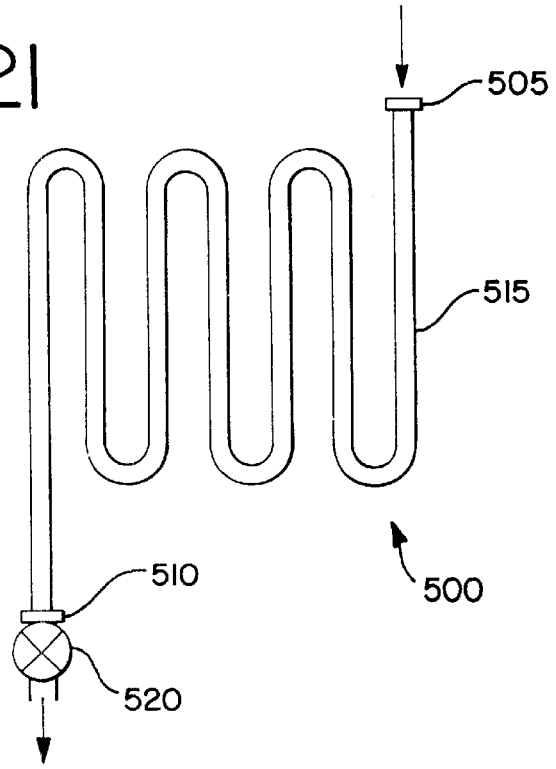
FIG. 21 is a side view of a fast-action capillary tube in accordance with a further embodiment of the present invention.

Shown in FIG. 2 is a side view, in partial cross-section, of one embodiment of multifunctional valve 18. Heat transfer fluid enters first inlet 24 and traverses a first passageway 38 to a common chamber 40. An expansion valve 42 is positioned in first passageway 38 near first inlet 24. Expansion valve 42 meters the flow of the heat transfer fluid through first passageway 38 by means of a diaphragm (not shown) enclosed within an upper valve housing 44. Expansion valve 42 can be any metering unit known to one of ordinary skill in the art that can be used to meter the flow of heat transfer fluid, such as a thermostatic expansion valve, a capillary tube, or a pressure control. In one preferred embodiment, expansion valve 42 is a fast-action capillary tube 500, as illustrated in FIG. 21. Fast-action capillary tube 500 includes an inlet 505, an outlet 510, an expansion line 515, and a gating valve 520. Heat transfer fluid enters fast-action capillary tube 500 at inlet 505 and passes through expansion line 515. Expansion line 515 is sized with a length and diameter such that heat transfer fluid is allowed to expand within expansion line 515. In one preferred embodiment, heat transfer fluid enter expansion line 515 as a liquid and expansion line 515 is sized such that heat transfer fluid expands from a liquid to a low quality liquid vapor mixture. Preferably, heat transfer fluid expands from a liquid to a high quality liquid vapor mixture within expansion line 515. Upon passing through expansion line 515, heat transfer fluid exits fast-action capillary tube 500 at outlet 510. Gating valve 520 is coupled to outlet 510 and control the flow of heat transfer fluid through fast-action capillary tube 500. Preferably, gating valve 520 is a solenoid valve capable of terminating the flow of heat transfer fluid through a passageway, such as expansion line 515, in response to an electrical signal. However, gating valve 520 may be any valve capable of terminating the flow of heat transfer fluid through a passageway known to one of ordinary skill, such as a valve that is mechanically activated.

When a vapor compression system, such as vapor compression system 10, is in operation, heat transfer fluid is pumped through fast-action capillary tube 500 from inlet 505 to outlet 510, and gating valve 520 is opened to allow heat transfer fluid to exit from fast-action capillary tube 500. When a vapor compression system has ceased operation, or has been cycled off, gating valve 520 is closed to allow heat transfer fluid to fill up fast-action capillary tube 500. By allowing fast-action capillary tube 500 to fill up with heat transfer fluid, fast-action capillary tube 500 is able to immediately supply a unit, such as an evaporator, with a rush of heat transfer fluid in a liquid state. By being able to supply a unit, such as an evaporator, with a rush of heat transfer fluid in a liquid state, fast-action capillary tube 500 allows a vapor compression system to cycle on, or begin operation, rapidly.

Control line 33 is connected to an input 62 located on upper valve housing 44. Signals relayed through control line 33 activate the diaphragm within upper valve housing 44. The diaphragm actuates a valve assembly 54 (shown in FIG. 4) to control the amount of beat transfer fluid entering an expansion chamber 52 (shown in FIG. 4) from first inlet 24. A gating valve 46 is positioned in first passageway 38 near common chamber 40. In a preferred embodiment of the invention, gating valve 46 is a solenoid valve capable of terminating the flow of heat transfer fluid through first passageway 38 in response to an electrical signal.

Figure 3:
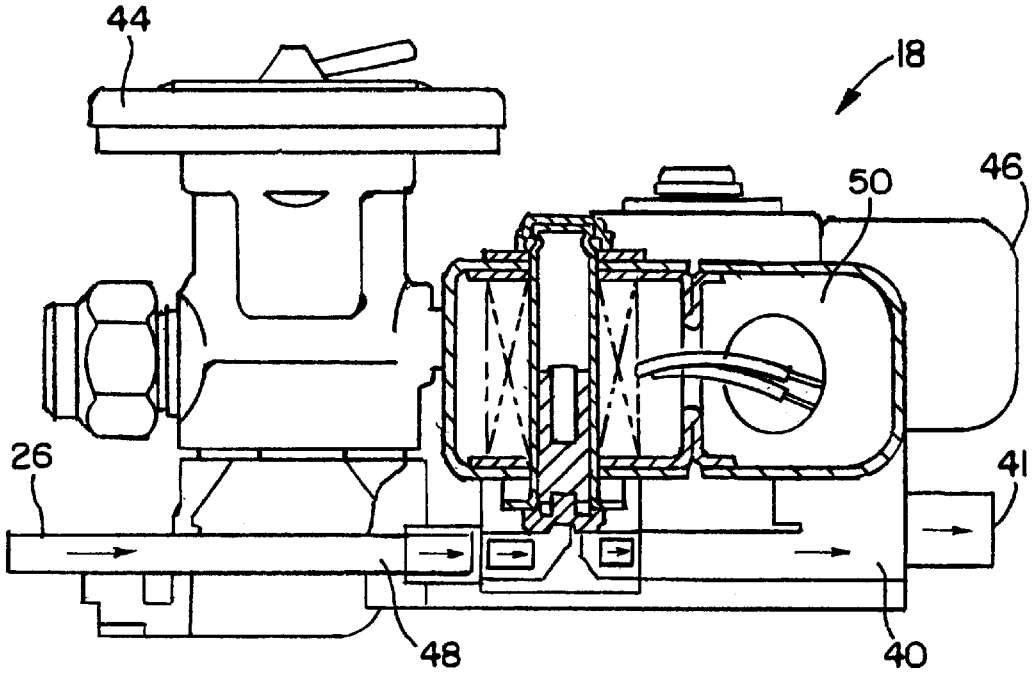
FIG. 3 is a side view, in partial cross-section, of a second side of the multifunctional valve illustrated in FIG. 2.

Shown in FIG. 3 is a side view, in partial cross-section, of a second side of multifunctional valve 18. A second passageway 48 couples second inlet 26 to common chamber 40. A gating valve 50 is positioned in second passageway 48 near common chamber 40. In a preferred embodiment of the invention, gating valve 50 is a solenoid valve capable of terminating the flow of heat transfer fluid through second passageway 48 upon receiving an electrical signal. Common chamber 40 discharges the heat transfer fluid from multifunctional valve 18 through an outlet 41.

Figure 4:
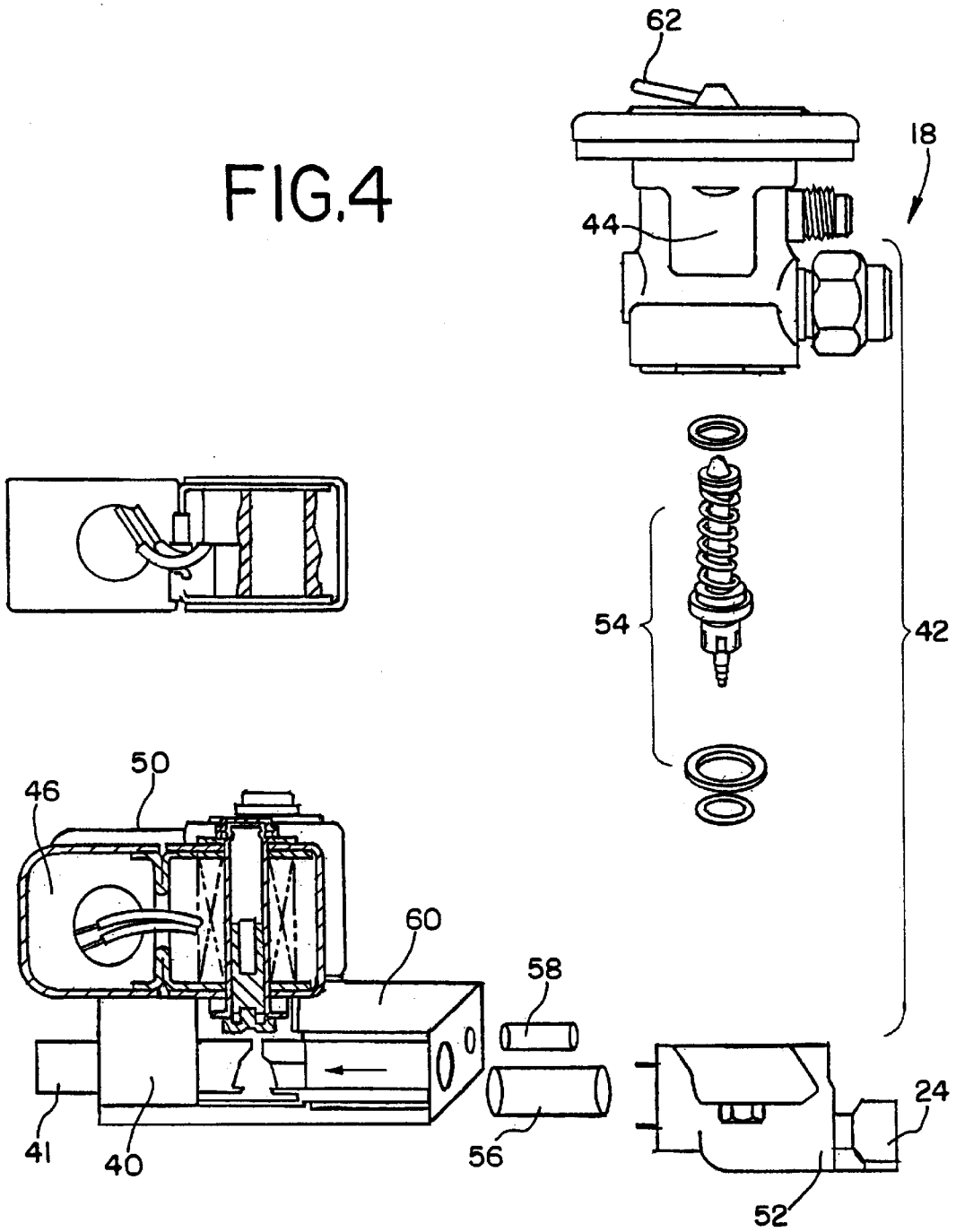
FIG. 4 is an exploded view of a multifunctional valve in accordance with one embodiment of the invention.

An exploded perspective view of multifunctional valve 18 is illustrated in FIG. 4. Expansion valve 42 is seen to include expansion chamber 52 adjacent first inlet 24, valve assembly 54, and upper valve housing 44. Valve assembly 54 is actuated by a diaphragm (not shown) contained within the upper valve housing 44. First and second tubes 56 and 58 are located intermediate to expansion chamber 52 and a valve body 60. Gating valves 46 and 50 are mounted on valve body 60. In accordance with the invention, vapor compression system 10 can be operated in a defrost mode by closing gating valve 46 and opening gating valve 50. In defrost mode, high temperature heat transfer fluid enters second inlet 26 and traverses second passageway 48 and enters common chamber 40. The high temperature vapors are discharged through outlet 41 and traverse saturated vapor line 28 to evaporator 16. The high temperature vapor has a temperature sufficient to raise the temperature of evaporator 16 by about 50 to 120° F. (27.8 to 66.7° C.). The temperature rise is sufficient to remove frost from evaporator 16 and restore the heat transfer rate to desired operational levels.

While the above embodiments use a multifunctional valve 18 for expanding the heat transfer fluid before entering evaporator 16, any thermostatic expansion valve or throttling valve, such as expansion valve 42 or even recovery valve 19, may be used to expand heat transfer fluid before entering evaporator 16.

Figure 9:
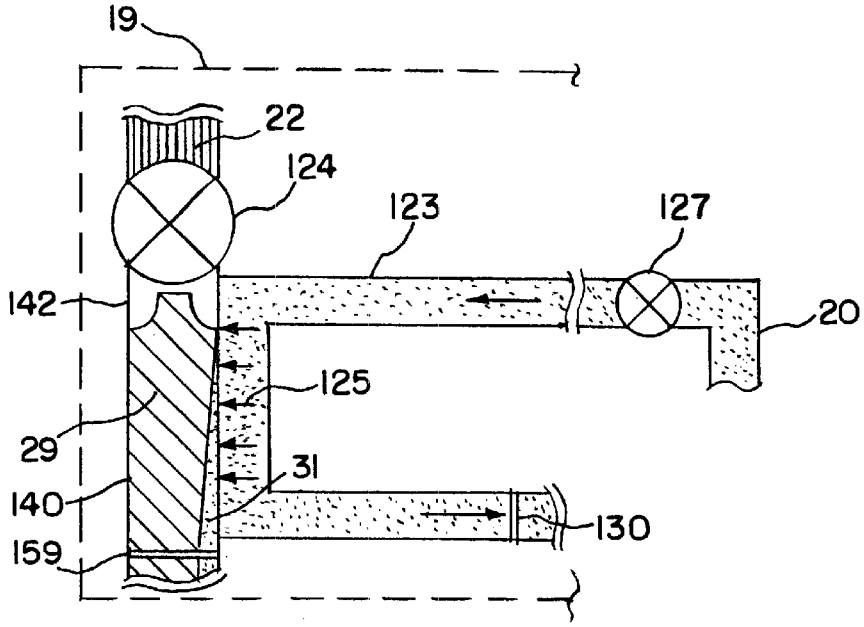
FIG. 9 is a schematic view, in partial cross-section, of a recovery valve in accordance with one embodiment of this invention.
Figure 10:
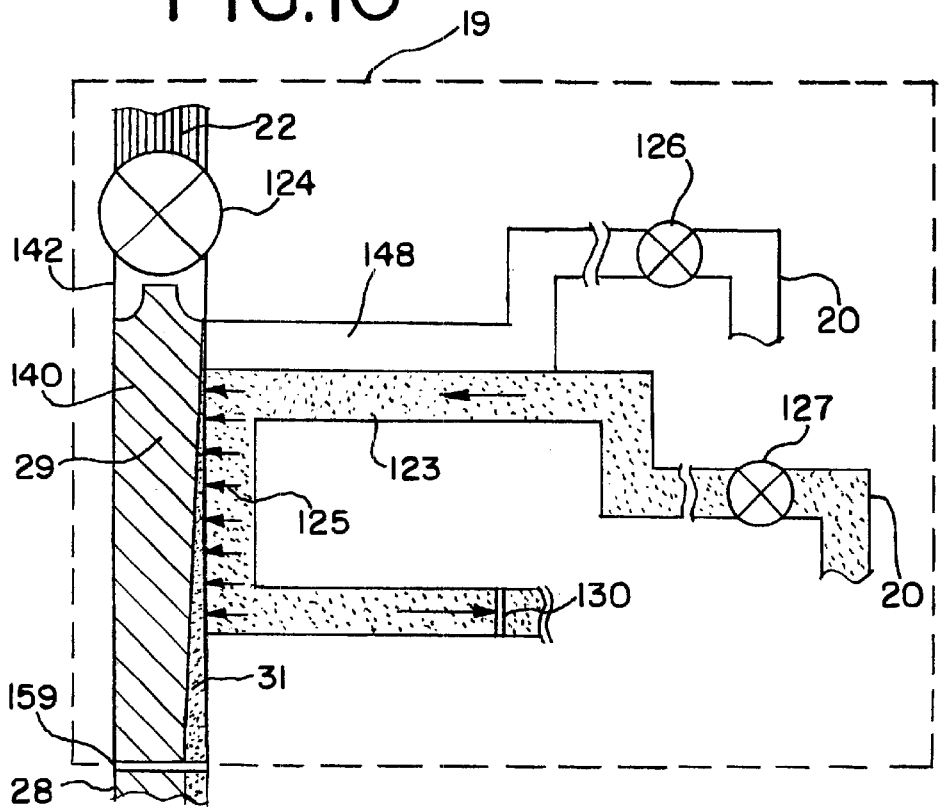
FIG. 10 is a schematic view, in partial cross-section, of a recovery valve in accordance with yet another embodiment of this invention.
Figure 12:
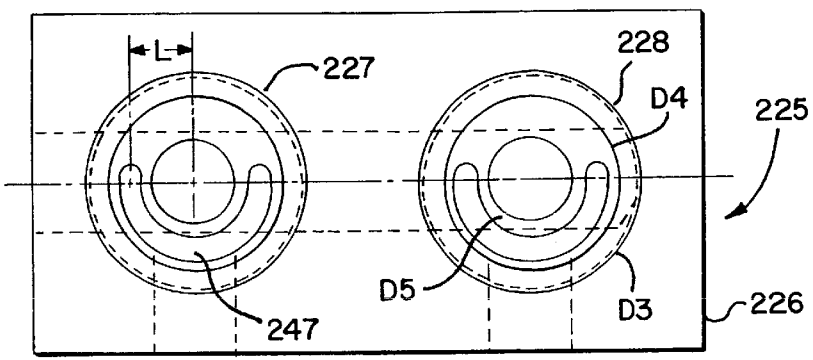
FIG. 12 is a side elevational view of the valve body for the multifunctional valve shown in FIG. 11.

In one preferred embodiment of the invention heat source 25 is applied to the heat transfer fluid after the heat transfer fluid passes through expansion valve 42 and before the heat transfer fluid enters the inlet of evaporator 16 to convert the heat transfer fluid from a low quality liquid vapor mixture to a high quality liquid vapor mixture, or a saturated vapor. In one preferred embodiment of the invention, heat source 25 is applied to a multifunctional valve 18. In another preferred embodiment of the invention heat source 25 is applied within recovery valve 19, as illustrated in FIG. 9. Recovery valve 19 comprises a first inlet 124 connected to liquid line 22 and a first outlet 159 connected to saturated vapor line 28. Heat transfer fluid enters first inlet 124 of recovery valve 19 to a common chamber 140. An expansion valve 142 is positioned near first inlet 124 to expand the heat transfer fluid entering first inlet 124 from a liquid state to a low quality liquid vapor mixture. Second inlet 127 is connected to discharge line 20, and receives high temperature heat transfer fluid exiting compressor 12. High temperature heat transfer fluid exiting compressor 12 enters second inlet 127 and traverses second passageway 123. Second passageway 123 is connected to second inlet 127 and second outlet 130. A portion of second passageway 123 is located adjacent to common chamber 140.

As the high temperature heat transfer fluid nears common chamber 140, heat from the high temperature heat transfer fluid is transferred from the second passageway 123 to the common chamber 140 in the form of heat source 125. By applying heat from heat source 125 to the heat transfer fluid in common chamber 140, the heat transfer fluid in common chamber 140 is converted from a low quality liquid vapor mixture to a high quality liquid vapor mixture, or saturated vapor, as the heat transfer fluid flows through common chamber 140. Additionally, the high temperature heat transfer fluid in the second passageway 123 is cooled as the high temperature heat transfer fluid passes near common chamber 140. Upon traversing second passageway 123, the cooled high temperature heat transfer fluid exits second outlet 130 and enters condensor 14. Heat transfer fluid in common chamber 140 exits recovery valve 19 at first outlet 159 into saturated vapor line 28 as a high quality liquid vapor mixture, or saturated vapor.

While in the above preferred embodiment, heat source 125 comprises heat transferred to the ambient surroundings from a compressor, heat source 125 may comprise any external or internal source of heat known to one of ordinary skill in the art, such as, for example, heat generated from an electrical heat source, heat generated using combustible materials, heat generated using solar energy, or any other source of heat. Heat source 125 can also comprise any heat source 25 and any active heat source, as previously defined.

In one preferred embodiment of the invention, recovery valve 19 comprises third passageway 148 and third inlet 126. Third inlet 126 is connected to discharge line 20, and receives high temperature heat transfer fluid exiting compressor 12. A first gating valve (not shown) capable of terminating the flow of heat transfer fluid through common chamber 140 is positioned near the first inlet 124 of common chamber 140. Third passageway 148 connects third inlet 126 to common chamber 140. A second gating valve (not shown) is positioned in third passageway 148 near common chamber 140. In a preferred embodiment of the invention, the second gating valve is a solenoid valve capable of terminating the flow of heat transfer fluid through third passageway 148 upon receiving an electrical signal.

In accordance with the invention, vapor compression system 10 can be operated in a defrost mode by closing the first gating valve located near first inlet 124 of common chamber 140 and opening the second gating valve positioned in third passageway 148 near common chamber 140. In defrost mode, high temperature heat transfer fluid from compressor 12 enters third inlet 126 and traverses third passageway 148 and enters common chamber 140. The high temperature heat transfer fluid is discharged through first outlet 159 of recovery valve 19 and traverses saturated vapor line 28 to evaporator 16. The high temperature heat transfer fluid has a temperature sufficient to raise the temperature of evaporator 16 by about 50 to 120° F. (27.8 to 66.7° C.). The temperature rise is sufficient to remove frost from evaporator 16 and restore the heat transfer rate to desired operational levels.

During the defrost cycle, any pockets of oil trapped in the vapor compression system will be warmed and carried in the same direction of flow as the heat transfer fluid. By forcing hot gas through the vapor compression system in a forward flow direction, the trapped oil will eventually be returned to the compressor. The hot gas will travel through the vapor compression system at a relatively high velocity, giving the gas less time to cool thereby improving the defrosting efficiency. The forward flow defrost method of the invention offers numerous advantages to a reverse flow defrost method. For example, reverse flow defrost systems employ a small diameter check valve near the inlet of the evaporator. The check valve restricts the flow of hot gas in the reverse direction reducing its velocity and hence its defrosting efficiency. Furthermore, the forward flow defrost method of the invention avoids pressure build up in the vapor compression system during the defrost system. Additionally, reverse flow methods tend to push oil trapped in the vapor compression system back into the expansion valve. This is not desirable because excess oil in the expansion valve can cause gumming that restricts the operation of the expansion valve. Also, with forward defrost, the liquid line pressure is not reduced in any additional refrigeration circuits being operated in addition to the defrost circuit.

It will be apparent to those skilled in the art that a vapor compression system arranged in accordance with the invention can be operated with less heat transfer fluid those comparable sized system of the prior art. By locating the multifunctional valve near the condenser, rather than near the evaporation, the saturated vapor line is filled with a relatively low-density vapor, rather than a relatively high-density liquid. Alternatively, by applying a heat source to the saturated vapor line, the saturated vapor line is also filled with a relatively low-density vapor, rather than a relatively high-density liquid. Additionally, prior art systems compensate for low temperature ambient operations (e.g. winter time) by flooding the evaporator in order to reinforce a proper head pressure at the expansion valve. In one preferred embodiment of the invention, vapor compression system heat pressure is more readily maintained in cold weather, since the multifunctional valve is positioned in close proximity to the condenser.

The forward flow defrost capability of the invention also offers numerous operating benefits as a result of improved defrosting efficiency. For example, by forcing trapped oil back into the compressor, liquid slugging is avoided, which has the effect of increasing the useful life of the equipment. Furthermore, reduced operating cost are realized because less time is required to defrost the vapor compression system. Since the flow of hot gas can be quickly terminated, the vapor compression system can be rapidly returned to normal cooling operation. When frost is removed from evaporator 16, temperature sensor 32 detects a temperature increase in the heat transfer fluid in suction line 30. When the temperature rises to a given set point, gating valve 50 and multifunctional valve 18 is closed. Once the flow of heat transfer fluid through first passageway 38 resumes, cold saturated vapor quickly returns to evaporator 16 to resume refrigeration operation.

Those skilled in the art will appreciate that numerous modifications can be made to enable the vapor compression system of the invention to address a variety of applications. For example, vapor compression systems operating in retail food outlets typically include a number of refrigeration cases that can be serviced by a common compressor system. Also, in applications requiring refrigeration operations with high thermal loads, multiple compressors can be used to increase the cooling capacity of the vapor compression system.

Figure 5:
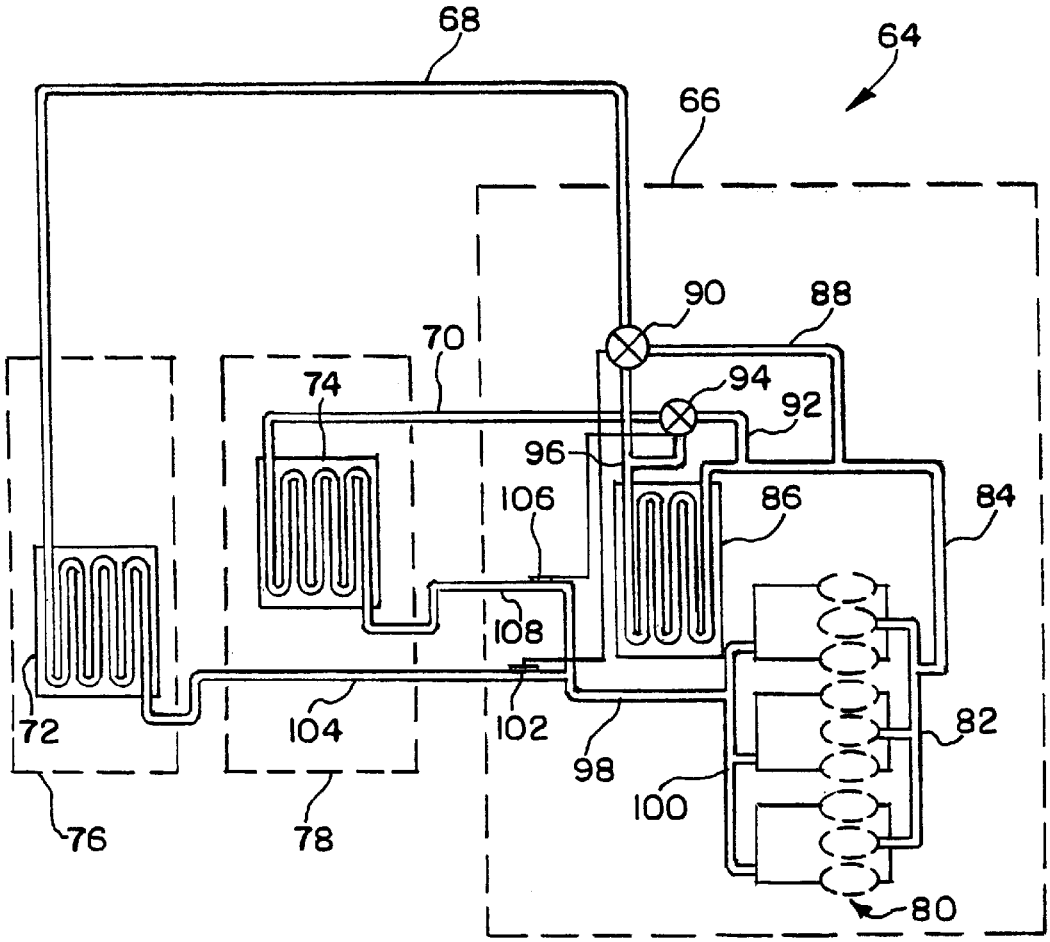
FIG. 5 is a schematic view of a vapor-compression system in accordance with another embodiment of the invention.

A vapor compression system 64 in accordance with another embodiment of the invention having multiple evaporators and multiple compressors is illustrated in FIG. 5. In keeping with the operating efficiency and low-cost advantages of the invention, the multiple compressors, the condenser, and the multiple multifunctional valves are contained within a control unit 66. Saturated vapor lines 68 and 70 feed saturated vapor from control unit 66 to evaporators 72 and 74, respectively. Evaporator 72 is located in a first refrigeration case 76, and evaporator 74 is located in a second refrigeration case 78. First and second refrigeration cases 76 and 78 can be located adjacent to each other, or alternatively, at relatively great distance from each other. The exact location will depend upon the particular application. For example, in a retail food outlet, refrigeration cases are typically placed adjacent to each other along an isle way. Importantly, the vapor compression system of the invention is adaptable to a wide variety of operating environments. This advantage is obtained, in part, because the number of components within each refrigeration case is minimal. In one preferred embodiment of the invention, by avoiding the requirement of placing numerous system components in proximity to the evaporator, the vapor compression system can be used where space is at a minimum. This is especially advantageous to retail store operations, where floor space is often limited.

In operation, multiple compressors 80 feed heat transfer fluid into an output manifold 82 that is connected to a discharge line 84. Discharge line 84 feeds a condenser 86 and has a first branch line 88 feeding a first multifunctional valve 90 and a second branch line 92 feeding a second multifunctional valve 94. A bifurcated liquid line 96 feeds heat transfer fluid from condenser 86 to first and second multifunctional valves 90 and 94. Saturated vapor line 68 couples first multifunctional valve 90 with evaporator 72, and saturated vapor line 70 couples second multifunctional valve 94 with evaporator 74. A bifurcated suction line 98 couples evaporators 72 and 74 to a collector manifold 100 feeding multiple compressors 80. A temperature sensor 102 is located on a first segment 104 of bifurcated suction line 98 and relays signals to first multifunctional valve 90. A temperature sensor 106 is located on a second segment 108 of bifurcated suction line 98 and relays signals to second multifunctional valve 94. In one preferred embodiment of the invention, a heat source, such as heat source 25, can be applied to saturated vapor lines 68 and 70 to insure that the heat transfer fluid enters evaporators 72 and 74 as a saturated vapor.

Those skilled in the art will appreciate that numerous modifications and variations of vapor compression system 64 can be made to address different refrigeration applications. For example, more than two evaporators can be added to the vapor compression system in accordance with the general method illustrated in FIG. 5. Additionally, more condensers and more compressors can also be included in the vapor compression system to further increase the cooling capability.

Figure 6:
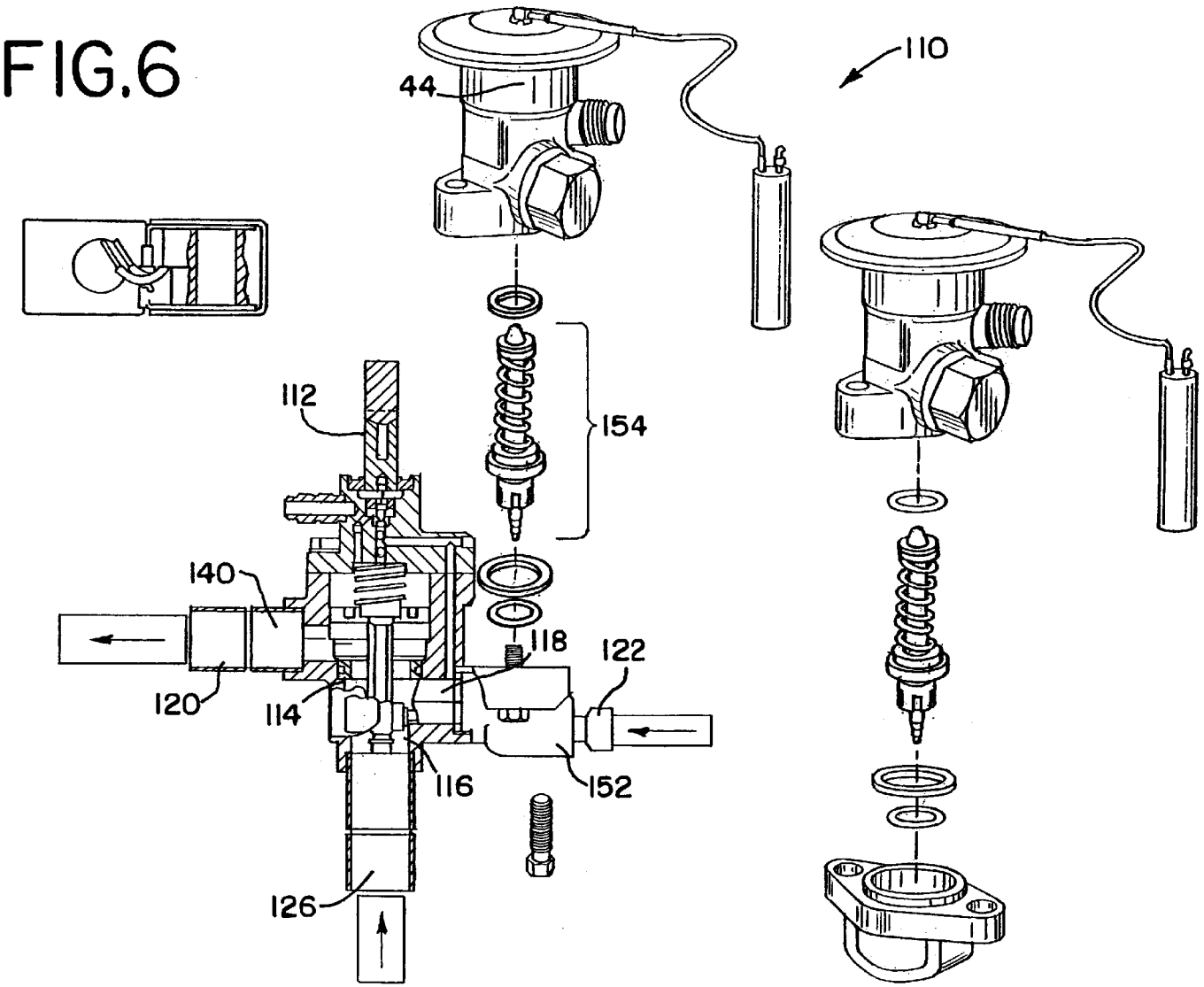
FIG. 6 is an exploded view of the multifunctional valve in accordance with another embodiment of the invention.

A multifunctional valve 110 arranged in accordance with another embodiment of the invention is illustrated in FIG. 6. In similarity with the previous multifunctional valve embodiment, the heat transfer fluid exiting the condenser in the liquid state enters a first inlet 122 and expands in expansion chamber 152. The flow of heat transfer fluid is metered by valve assembly 154. In the present embodiment, a solenoid valve 112 has an armature 114 extending into a common seating area 116. In refrigeration mode, armature 114 extends to the bottom of common seating area 116 and cold refrigerant flows through a passageway 118 to a common chamber 140, then to an outlet 120. In defrost mode, hot vapor enters second inlet 126 and travels through common seating area 116 to common chamber 140, then to outlet 120. Multifunctional valve 110 includes a reduced number of components, because the design is such as to allow a single gating valve to control the flow of hot vapor and cold vapor through the multifunctional valve 110.

In yet another embodiment of the invention, the flow of liquefied heat transfer fluid from the liquid line through the multifunctional valve can be controlled by a check valve positioned in the first passageway to gate the flow of the liquefied heat transfer fluid into the saturated vapor line. The flow of heat transfer fluid through the vapor compression system is controlled by a pressure valve located in the suction line in proximity to the inlet of the compressor.

Accordingly, the various functions of a multifunctional valve of the invention can be performed by separate components positioned at different locations within the vapor compression system. All such variations and modifications are contemplated by the present invention.

Those skilled in the art will recognize that the vapor compression system and method described herein can be implemented in a variety of configurations. For example, the compressor, condenser, multifunctional valve, and the evaporator can all be housed in a single unit and placed in a walk-in cooler. In this application, the condenser protrudes through the wall of the walk-in cooler and ambient air outside the cooler is used to condense the heat transfer fluid.

In another application, the vapor compression system and method of the invention can be configured for air-conditioning a home or business. In this application, a defrost cycle is unnecessary since icing of the evaporator is usually not a problem.

In yet another application, the vapor compression system and method of the invention can be used to chill water. In this application, the evaporator is immersed in water to be chilled. Alternatively, water can be pumped through tubes that are meshed with the evaporator coils.

In a further application, the vapor compression system and method of the invention can be cascaded together with another system for achieving extremely low refrigeration temperatures. For example, two systems using different heat transfer fluids can be coupled together such that the evaporator of a first system provide a low temperature ambient. A condenser of the second system is placed in the low temperature ambient and is used to condense the heat transfer fluid in the second system.

Another embodiment of a multifunctional valve 225 is shown in FIGS. 11–14 and is generally designated by the reference numeral 225. This embodiment is functionally similar to that described in FIGS. 2–4 and FIG. 6 which was generally designated by the reference numeral 18. As shown, this embodiment includes a main body or housing 226 which preferably is constructed as a single one-piece structure having a pair of threaded bosses 227, 228 that receive a pair of gating valves and collar assemblies, one of which being shown in FIG. 13 and designated by the reference numeral 229. This assembly includes a threaded collar 230, gasket 231 and solenoid-actuated gating valve receiving member 232 having a central bore 233, that receives a reciprocally movable valve pin 234 that includes a spring 235 and needle valve element 236 which is received with a bore 237 of a valve seat member 238 having a resilient seal 239 that is sized to be sealingly received in well 240 of the housing 226. A valve seat member 241 is snuggly received in a recess 242 of valve seat member 238. Valve seat member 241 includes a bore 243 that cooperates with needle valve element 236 to regulate the flow of heat transfer fluid therethrough.

A first inlet 244 (corresponding to first inlet 24 in the previously described embodiment) receives liquid feed heat transfer fluid from expansion valve 42, and a second inlet 245 (corresponding to second inlet 26 of the previously described embodiment) receives hot gas from the compressor 12 during a defrost cycle. In one preferred embodiment multifunctional valve 225 comprises first inlet 244, outlet 248, common chamber 246, and expansion valve 42, as illustrated in FIG. F. In one preferred embodiment, expansion valve 42 is connected with first inlet 244. The valve body 226 includes a common chamber 246 (corresponding to common chamber 40 in the previously described embodiment). Expansion valve 42 receives heat transfer fluid from the condenser 14 which then passes through inlet 244 into a semicircular well 247 which, when gating valve 229 is open, then passes into common chamber 246 and exits from the multifunctional valve 225 through outlet 248 (corresponding to outlet 41 in the previously described embodiment).

Figure 11:
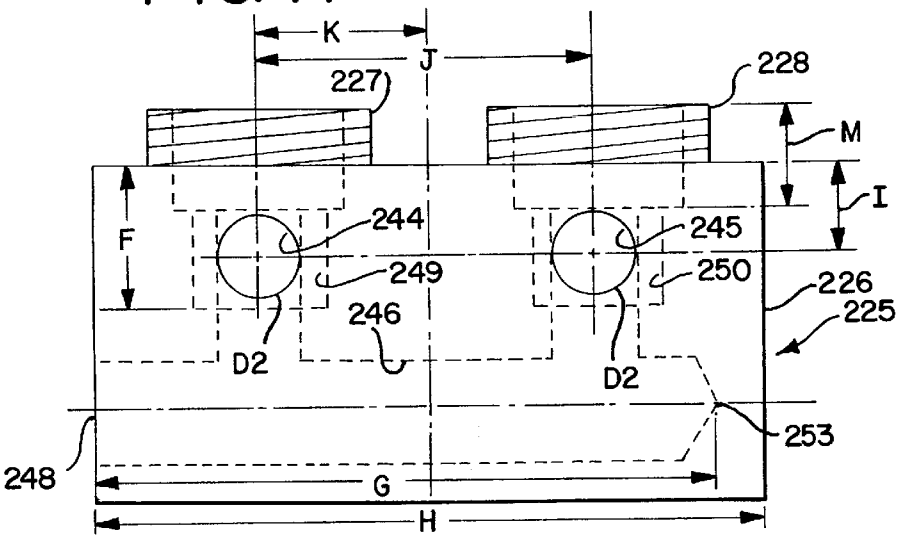
FIG. 11 is a plan view, partially in section, of a valve body for a multifunctional valve in accordance with a further embodiment of the present invention.
Figure 13:
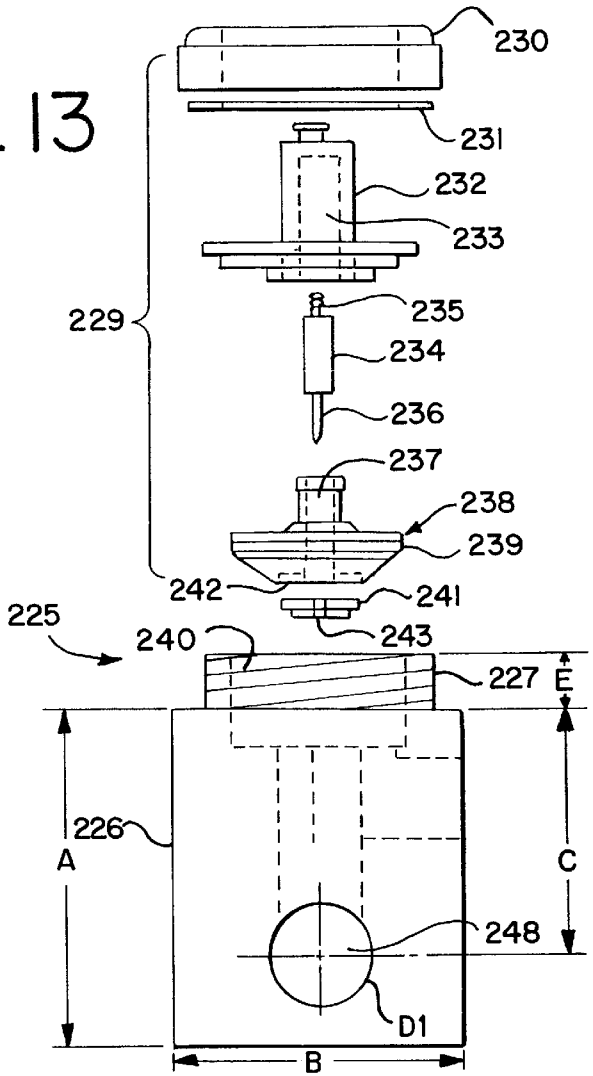
FIG. 13 is an exploded view, partially in section, of the multifunctional valve shown in FIGS. 11 and 12.
Figure 14:
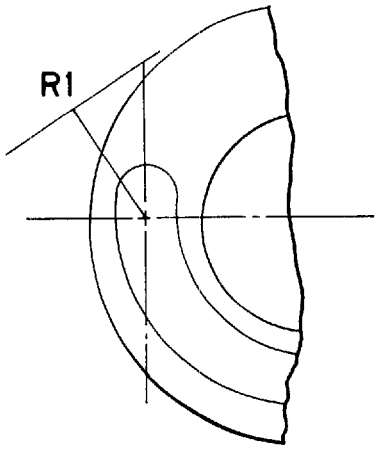
FIG. 14 is an enlarged view of a portion of the multifunctional valve shown in FIG. 12.

A best shown in FIG. 11 the valve body 226 includes a first passageway 249 (corresponding to first passageway 38 of the previously described embodiment) which communicates first inlet 244 with common chamber 246. In like fashion, a second passageway 250 (corresponding to second passageway 48 of the previously described embodiment) communicates second inlet 245 with common chamber 246.

Insofar as operation of multifunctional valve 225 is concerned, reference is made to the previously described embodiment since the components thereof function in the same way during the refrigeration and defrost cycles. In one preferred embodiment, the heat transfer fluid exits the condenser 14 in the liquid state passes through expansion valve 42. As the heat transfer fluid passes through expansion valve 42, the heat transfer fluid changes from a liquid to a liquid vapor mixture, wherein the heat transfer fluid is in both a liquid state and a vapor state. The heat transfer fluid enters the first inlet 244 as a liquid vapor mixture and expands in common chamber 246.

In one preferred embodiment, the heat transfer fluid expands in a direction away from the general flow of the heat transfer fluid. As the heat transfer fluid expands in common chamber 246, the liquid separates from the vapor in the heat transfer fluid. The heat transfer fluid then exits common chamber 246. Preferably, the heat transfer fluid exits common chamber 246 as a liquid and a vapor, wherein a substantial amount of the liquid is separate and apart from a substantial amount of the vapor. The heat transfer fluid then passes through outlet 248 and travels through saturated vapor line 28 to evaporator 16. In one preferred embodiment, the heat transfer fluid then passes through outlet 248 and enters evaporator 16 at first evaporative line 328, as described in more detail below. Preferably, the heat transfer fluid travels from outlet 248 to the inlet of evaporator 16 as a liquid and a vapor, wherein a substantial amount of the liquid is separate and apart from a substantial amount of the vapor.

In one preferred embodiment, a pair of gating valves 229 can be used to control the flow of heat transfer fluid or hot vapor into common chamber 246. In refrigeration mode, a first gating valve 229 is opened to allow heat transfer fluid to flow through first inlet 244 and into common chamber 246, and then to outlet 248. In defrost mode, a second gating valve 229 is opened to allow hot vapor to flow through second inlet 245 and into common chamber 246, and then to outlet 248. While in the above embodiments, multifunctional valve 225 has been described as having multiple gating valves 229, multifunctional valve 225 can be designed with only one gating valve. Additionally, multifunctional valve 225 has been described as having a second inlet 245 for allowing hot vapor to flow through during defrost mode, multifunctional valve 225 can be designed with only first inlet 244.

Figure 15:
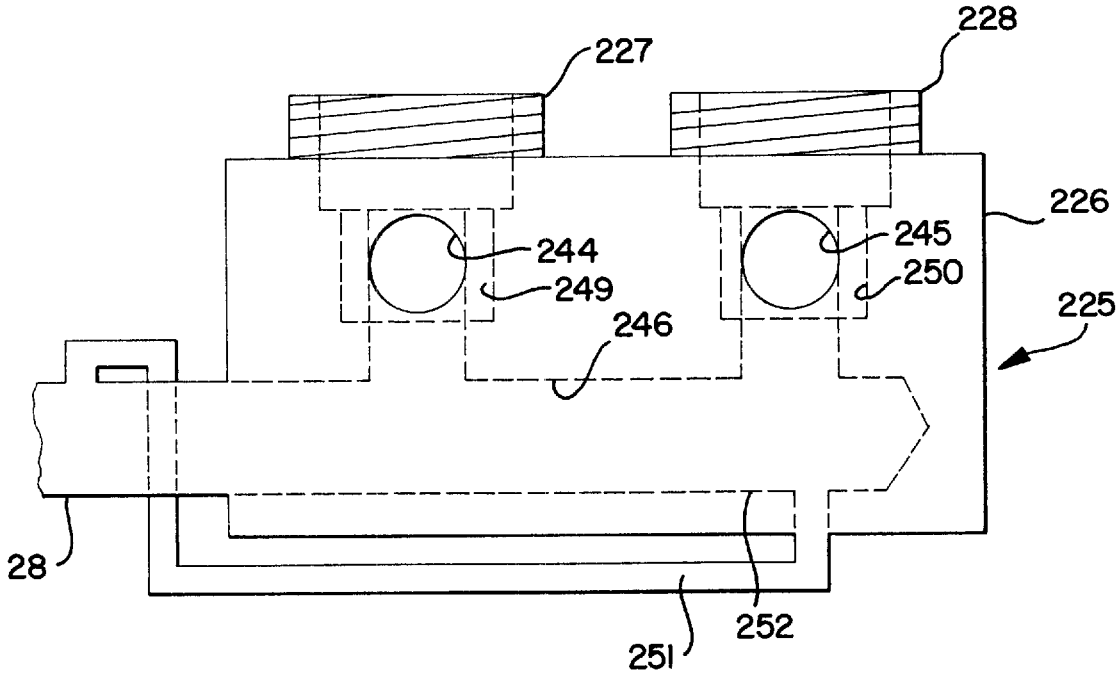
FIG. 15 is a plan view, partially in section, of a valve body for a multifunctional valve in accordance with a further embodiment of the present invention.

In one preferred embodiment, multifunctional valve 225 comprises bleed line 251, as illustrated in FIG. 15. Bleed line 251 is connected with common chamber 246 and allows heat transfer fluid that is in common chamber 246 to travel to saturated vapor line 28 or first evaporative line 328. In one preferred embodiment, bleed line 251 allows the liquid that has separated from the liquid vapor mixture entering common chamber 246 to travel to saturated vapor line 28 or first evaporative line 328. Preferably, bleed line 251 is connected to bottom surface 252 of common chamber 246, wherein bottom surface 252 is the surface of common chamber 246 located nearest the ground.

In one preferred embodiment, multifunctional valve 225 is dimensioned as specified below in Table A and as illustrated in FIGS. 11–14. The length of common chamber 246 will be defined as the distance from outlet 248 to back wall 253. The length of common chamber 246 is represented by the letter G, as illustrated in FIG. 11. Common chamber 246 has a first portion adjacent to a second portion, wherein the first portion begins at outlet 248 and the second portion ends at back wall 253, as illustrated in FIG. 11. First inlet 244 and outlet 248 are both connected with the first portion. The heat transfer fluid enters common chamber 246 through first inlet 244 and within the first portion of the common chamber 246. In one preferred embodiment, the first portion has a length equal to no more than about 75% of the length of common chamber 246. More preferably, the first portion has a length equal to no more than about 35% of the length of common chamber 246.

TABLE A

DIMENSIONS OF MULTIFUNCTIONAL VALVE

| Dimensions | Inches (all dimensions not specified are to be +/−0.015) | Millimeters (all dimensions not specified are to be +/−0.381) |
|---|---|---|
| A | 2.500 | 63.5 |
| B | 2.125 | 53.975 |
| C | 1.718 | 43.637 |
| D1 (diameter) | 0.812 | 20.625 |
| D2 (diameter) | 0.609 | 15.469 |
| D3 (diameter) | 1.688 | 42.875 |
| D4 (diameter) | 1.312 (+/−0.002) | 33.325 (+/−0.051) |
| D5 (diameter) | 0.531 | 13.487 |
| E | 0.406 | 10.312 |
| F | 1.062 | 26.975 |
| G | 4.500 | 114.3 |
| H | 5.000 | 127 |
| I | 0.781 | 19.837 |
| J | 2.500 | 63.5 |
| K | 1.250 | 31.75 |
| L | 0.466 | 11.836 |
| M | 0.812 (+/−0.005) | 20.6248 (+/−0.127) |
| R1 (radius) | 0.125 | 3.175 |

Figure 17:
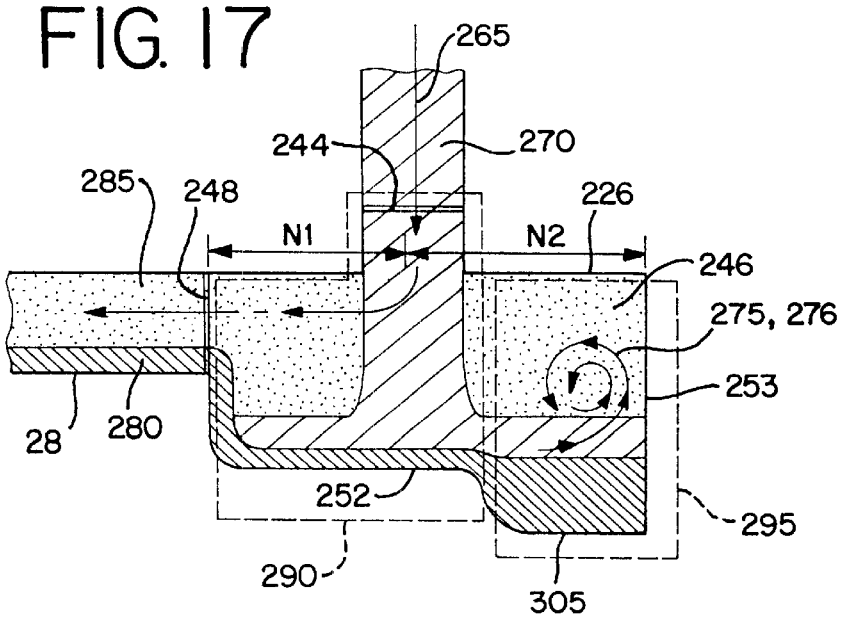
FIG. 17 is a cross sectional view of a valve body for a multifunctional valve in accordance with a further embodiment of the present invention.
Figure 18:
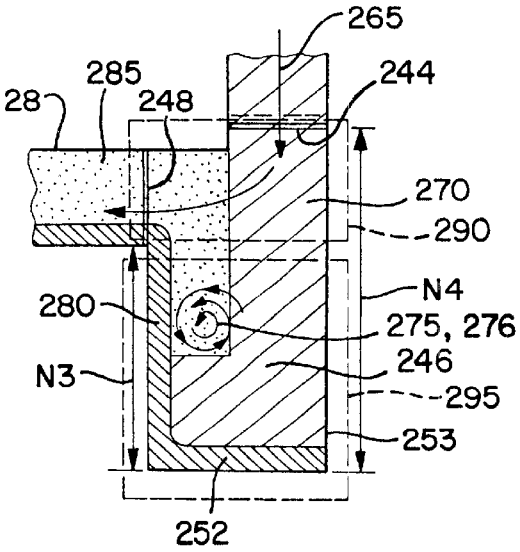
FIG. 18 is a cross sectional view of a valve body for a multifunctional valve in accordance with a further embodiment of the present invention.
Figure 19:
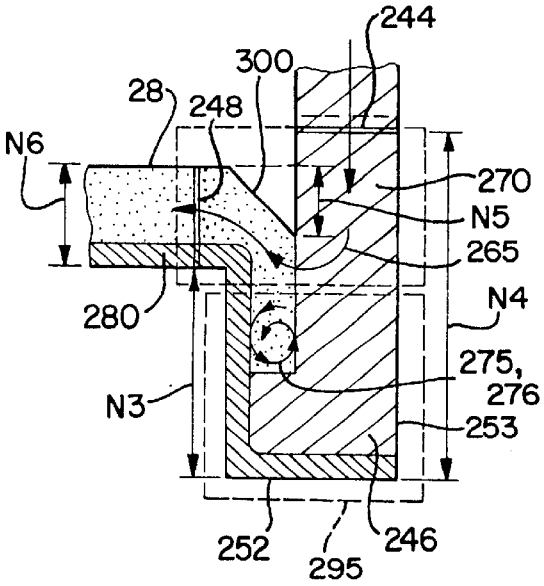
FIG. 19 is a cross sectional view of a valve body for a multifunctional valve in accordance with a further embodiment of the present invention.

In one preferred embodiment, the heat transfer fluid enters common chamber 246 through first inlet 244 as a low quality liquid vapor mixture 270. Liquid vapor mixture 270 is in both a liquid state and a vapor state, wherein the liquid is suspended within the vapor. As used herein, the heat transfer fluid that is in a liquid state will be referred to as liquid 280 and the heat transfer fluid that is in a vapor state will be referred to as vapor 285. As the heat transfer fluid passes from the inlet 244 of common chamber 246 to the outlet 248 of common chamber 246, a portion of liquid 280 coalesces. As used herein, the term "coalesces" means to unite or to fuse together. Therefore, when the phrase "a portion of liquid 280 coalesces" is used, it is meant that a portion of liquid 280 becomes united with or fused together with another portion of liquid 280. As the heat transfer fluid enters common chamber 246, liquid 280 is arranged with liquid vapor mixture 270 as liquid droplets suspended in vapor 280. After the heat transfer fluid enters common chamber 246 as a liquid vapor mixture 270, the slower moving liquid 280 begins to coalesce and settle at bottom surface 252 of common chamber 246 while the faster moving vapor 285 is forced through outlet 248, as illustrated in FIGS. 17–19. By allowing liquid 280 to coalesce and separate from vapor 285, heat is released from the liquid vapor mixture 270 allowing liquid 280 to cool off. The cooling off of liquid 280 decreases the enthalpy of liquid vapor mixture 270, converting the heat transfer fluid in common chamber 246 from a low quality liquid vapor mixture to a high quality liquid vapor mixture, or a saturated vapor.

In one preferred embodiment, as heat transfer fluid travels through common chamber 246, a portion of liquid 280 within liquid vapor mixture 270 coalesces into larger droplets which exit through outlet 248 along with vapor 285. In one preferred embodiment, the larger droplets of liquid 280 coalesces into a stream of liquid 280, wherein the stream of liquid 280 exits through outlet 248 along with a stream of vapor 285, as illustrated in FIGS. 17–19. Preferably, at least 10% of liquid 280 coalesces into larger droplets of liquid 280 or a stream of liquid 280. More preferably, at least 35% of liquid 280 coalesces into larger droplets of liquid 280 or a stream of liquid 280.

Common chamber 246 is divided into a first portion 290 and a second portion 295. First portion 290 includes first inlet 244 and outlet 248. By including first inlet 244 and outlet 248, first portion is also the portion of common chamber 246 upon which heat transfer fluid must flow through upon entering common chamber 246, and therefore the portion of common chamber 246 wherein flow direction 265 generally resides. Flow direction 265 is the general direction the heat transfer fluid flows as the heat transfer fluid travels from first inlet 244 to second inlet 248, as illustrated by arrows in FIGS. 17–19. Second portion 295 is located in common chamber 246 and allows for a portion of the heat transfer fluid to coalesce. Preferably, second portion 295 is located away from flow direction 265, as illustrated in FIGS. 17–19. By locating second portion 295 away from flow direction 265, the slower moving liquid 280 is allowed to accumulate in and coalesce in second portion 295 and the faster moving vapor 285 is able to become separated from liquid 280, as illustrated in FIGS. 17–19. Preferably, the heat transfer fluid exists common chamber 246 through outlet 248 as a high quality liquid vapor mixture, wherein liquid 280 has coalesced and is substantially separate and apart from vapor 285, as illustrated in FIGS. 17–19. Upon exiting common chamber 246 at outlet 248, the heat transfer fluid then passes through saturated vapor line 28 to evaporator 16.

In one preferred embodiment, the flow of heat transfer fluid is in a turbulent state upon entering first inlet 244, so that a portion of vapor 285 gets trapped in second portion 295, creating eddy 275 in common chamber 246, and more preferably in second portion 295 of common chamber 246. Eddy 275 is a current of heat transfer fluid that flows in a generally circular direction, as illustrated in FIGS. 17–19. Eddy 275 helps liquid 280 to coalesce. In one preferred embodiment, the heat transfer fluid enters first inlet 244 in a turbulent state and creates at least one vortex 276 in common chamber 246, and more preferably in second portion 295 of common chamber 246. Vortex 276, as defined herein, is a mass of heat transfer fluid having a whirling or circular motion that forms a cavity or vacuum in the center of the circle and that draws toward this cavity or vacuum bodies subject to this action. For example, when a vortex 276 is formed within common chamber 246, a cavity or vacuum forms in the center of vortex 276 that tends to draw vapor 285 away from liquid vapor mixture 270. In this way, liquid 280 can be separated from vapor 285 in liquid vapor mixture 270.

Common chamber 246 can comprise any one of a variety of geometrical configurations which allow a portion of liquid 280 to coalesce within common chamber 246 and separate from liquid 280. In one preferred embodiment, first inlet 244 is a distance N1 away from outlet 248 and a distance N2 from back wall 253, wherein the sum of N1 and N2 equals the length of common chamber 246, as illustrated in FIG. 17. Preferably, N1 is anywhere from about 5% to about 75% the length of common chamber 246. In one preferred embodiment, common chamber 246 includes reservoir 305 located along bottom surface 252 of common chamber 246, as illustrated in FIG. 17. Reservoir 305 traps a portion of heat transfer fluid within common chamber 246, which causes liquid 280 to coalesce.

In one preferred embodiment, inlet 244 is adjacent with back wall 253 and bottom surface 252 is located a distance N3 from outlet 248 and a distance N4 from inlet 244, as illustrated in FIGS. 18–19. N3 is anywhere from about 25% to about 95% the length of N4. In this configuration, second portion 295 is able to trap a portion of heat transfer fluid within common chamber 246, which causes liquid 280 to coalesce. In one preferred embodiment, common chamber 246 includes notch 300 between first inlet 244 and outlet 248, as illustrated in FIG. 19. Notch 300 reduces the amount of heat transfer fluid that can exit common chamber 246 through outlet 248. By reducing the amount of heat transfer fluid that can exits common chamber 246, notch 300 encourages the faster moving vapor 285 to separate from the slower moving liquid 280, which causes liquid 280 to coalesce. Preferably, notch 300 has a height N5 and outlet 248 has a diameter N6, wherein N5 is anywhere from about 15% to about 95% of N6. The embodiments of common chamber 246 discussed above, and as illustrated in FIGS. 17–19, are merely illustrative of the invention and are not meant to limit the scope in any way whatsoever.

Figure 16:
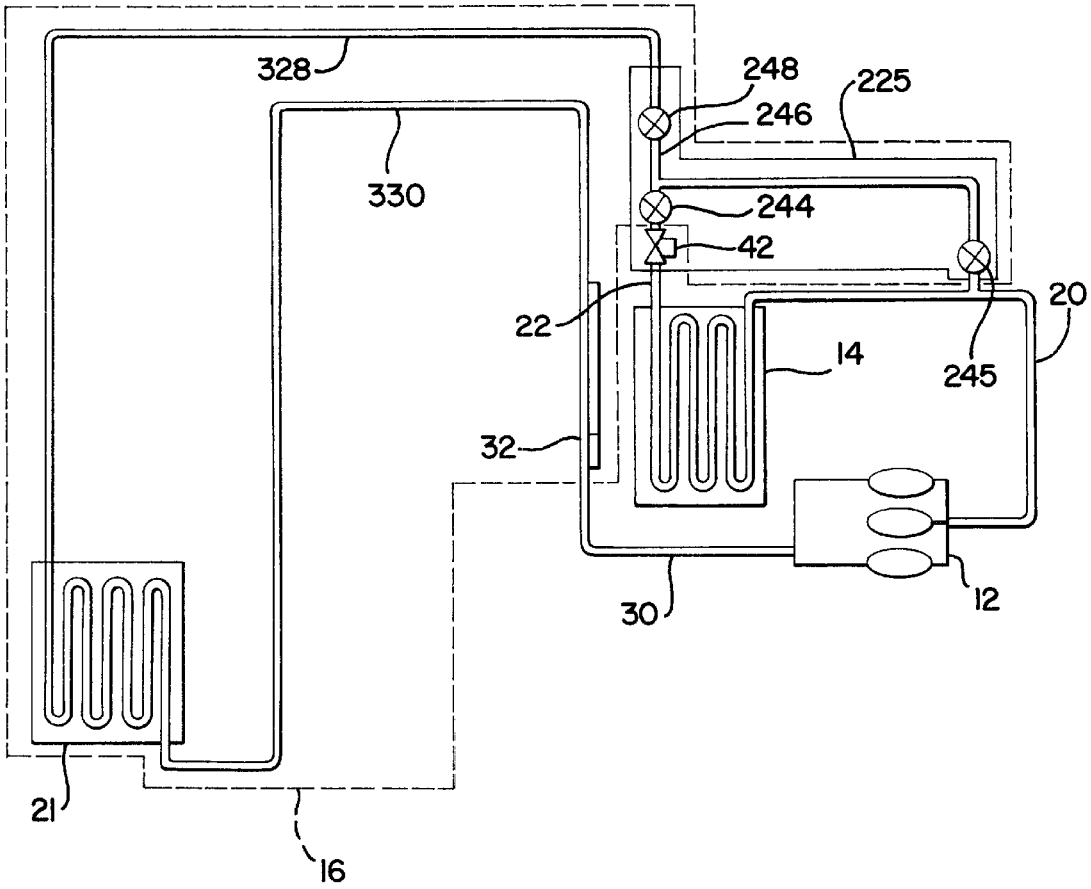
FIG. 16. is a schematic drawing of a vapor-compression system arranged in accordance with another embodiment of the invention.

In one preferred embodiment, the flow rate upon which heat transfer fluid is forced through first inlet 244 is increased to facilitate the separation of liquid 280 from vapor 285 in liquid vapor mixture 270, which causes liquid 280 to coalesce. For example, in a vapor compression system having a compressor of size X, a condenser of size Y, an evaporator of size Z, and first inlet 244 having a diameter of D, if the flow rate is increased from A to B, liquid 280 will more readily separate from vapor 285 and coalesce. Preferably, the flow rate of heat transfer fluid is increased so that the heat transfer fluid entering common chamber 226 is in a turbulent flow. More preferably, the flow rate of heat transfer fluid is increased so that the heat transfer fluid entering common chamber 246 is at such a rate that Eddy 275 forms within common chamber 246, as illustrated in FIGS. 17–19. In one preferred embodiment, the heat transfer fluid passes through expansion valve 42 and then enters the inlet of evaporator 16, as illustrated in FIG. 16. In this embodiment, evaporator 16 comprises first evaporative line 328, evaporator coil 21, and second evaporative line 330. First evaporative line 328 is positioned between outlet 248 and evaporator coil 21, as illustrated in FIG. 16. Second evaporative line 330 is positioned between evaporative coil 21 and temperature sensor 32. Evaporator coil 21 is any conventional coil that absorbs heat. Multifunctional valve 225 is preferably connected with and adjacent evaporator 16. In one preferred embodiment, evaporator 16 comprises a portion of multifunctional valve 225, such as first inlet 244, outlet 248, and common chamber 246, as illustrated in FIG. 16. Preferably, expansion valve 42 is positioned adjacent evaporator 16. Heat transfer fluid exits expansion valve 42 and then directly enters evaporator 16 at inlet 244. As the heat transfer fluid exits expansion valve 42 and enters evaporator 16 at inlet 244, the temperature of the heat transfer fluid is at an evaporative temperature, that is the heat transfer fluid begins to absorb heat upon passing through expansion valve 42.

Upon passing through inlet 244, common chamber 246, and outlet 248, the heat transfer fluid enters first evaporative line 328. Preferably, first evaporative line 328 is insulated. Heat transfer fluid then exits first evaporative line 328 and enters evaporative coil 21. Upon exiting evaporative coil 21, heat transfer fluid enters second evaporative line 330. Heat transfer fluid exists second evaporative line 330 and evaporator 16 at temperature sensor 32.

Preferably, every element within evaporator 16, such as saturated vapor line 28, multifunctional valve 225, and evaporator coil 21, absorbs heat. In one preferred embodiment, as the heat transfer fluid passes through expansion valve 42, the heat transfer fluid is at a temperature within 20° F. of the temperature of the heat transfer fluid within the evaporator coil 21. In another preferred embodiment, the temperature of the heat transfer fluid in any element within evaporator 16, such as saturated vapor line 28, multifunctional valve 225, and evaporator coil 21, is within 20° F. of the temperature of the heat transfer fluid in any other element within evaporator 16. While the above embodiments were described in reference to multifunctional valve 225, any multifunctional valve described herein, can be used as well.

Figure 20:
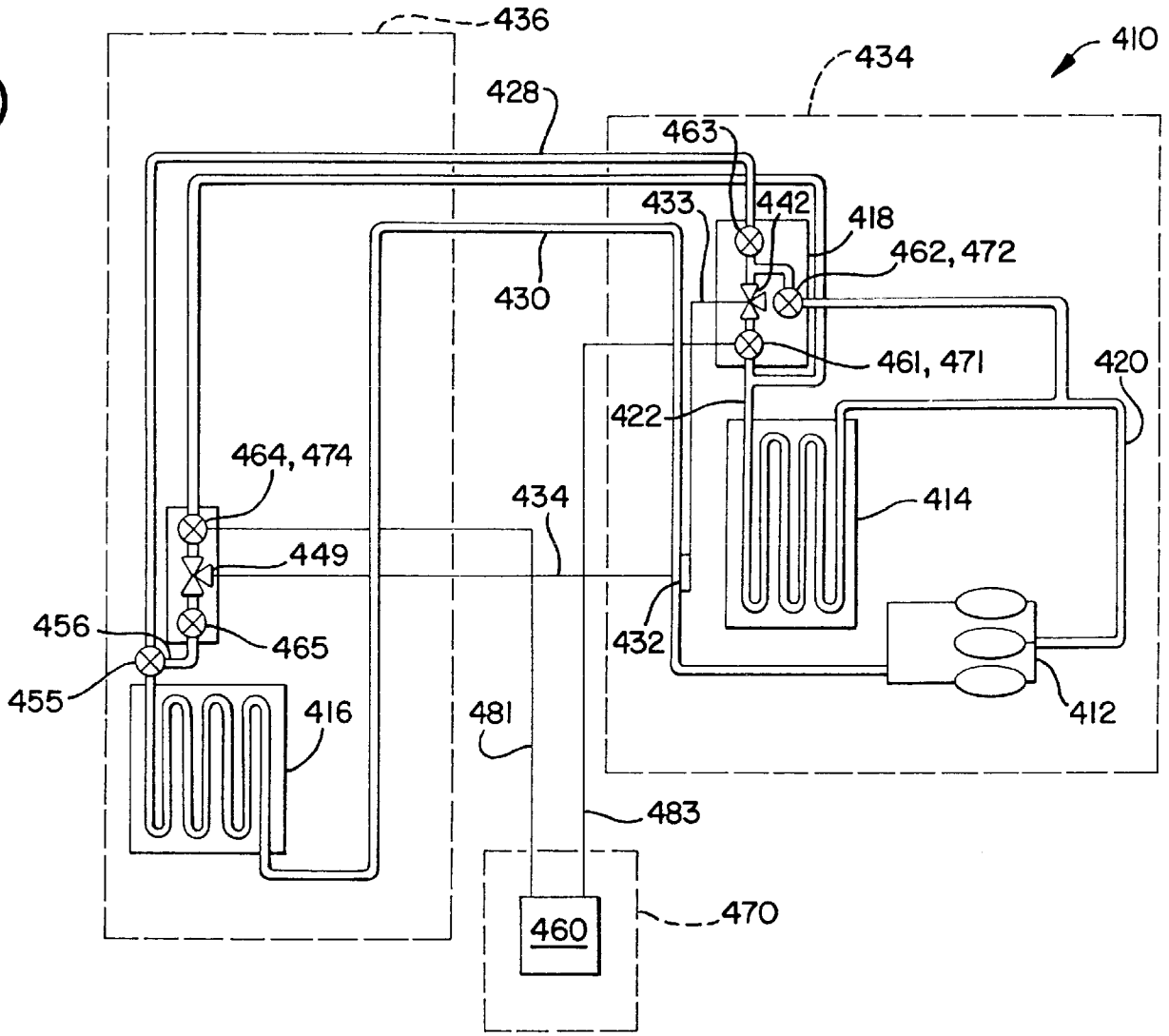
FIG. 20 is a schematic drawing of a vapor-compression system arranged in accordance with another embodiment of the invention.

In one preferred embodiment, vapor compression system 410 includes a compressor 412, a condenser 414, an evaporator 416, an XDX valve 418, and a metering unit 449, as illustrated in FIG. 20. XDX valve 418 is any device known to one of ordinary skill in the art that can be used to meter the flow of heat transfer fluid an that can convert the heat transfer fluid into a saturated vapor upon entering evaporator 16, as described in the above embodiments. Examples of XDX valve 418 are multifunctional valves 18, 90, 94, 110 and 225, recovery valve 19, any metering unit coupled to a relatively short liquid line and a relatively long saturated vapor line sufficient in length and diameter to vaporize a portion of the heat transfer fluid before the heat transfer fluid enters the evaporator, as described herein, and any metering unit in which a heat source is applied to the heat transfer fluid in the saturated vapor line sufficient to vaporize a portion of the heat transfer fluid before the heat transfer fluid enters the evaporator, as described herein. Metering unit 449 can be any device known to one of ordinary skill in the art that can be used to meter the flow of heat transfer fluid, such as a thermostatic expansion valve, a capillary tube, a fast-action capillary tube 500, or a pressure control.

Compressor 412 is coupled to condenser 414 by a discharge line 420. XDX valve 418 includes first inlet 461, second inlet 462 and outlet 463. Metering unit 449 includes inlet 464 and outlet 465. First inlet 461 of XDX valve 418 and inlet 464 of metering unit 449 are coupled to condenser 414 by a bifurcated liquid line 422.

A saturated vapor line 428 couples outlet 463 of XDX valve 418 to inlet 455 of evaporator 416, and a suction line 430 couples the outlet of evaporator 416 to the inlet of compressor 412. A refrigerant line 456 couples outlet 465 of metering unit 449 to inlet 455 of evaporator 416. A temperature sensor 432 is mounted to suction line 430 and is operably connected to XDX valve 418 and metering unit 449. Temperature sensor 432 relays temperature information through a control line 433 to XDX valve 418 and through a second control line 434 to metering unit 449.

In accordance with one preferred embodiment, the flow of heat transfer fluid from condenser 414 to evaporator 416 can be directed to go through either XDX valve 418 or metering unit 449. Preferably, the flow of heat transfer fluid from condenser 414 to evaporator 416 can be directed to go through either XDX valve 418 or metering unit 449 based on the conditions of the ambient surroundings 470. Ambient surroundings 470 is the area or space in which the conditions, such as temperature and humidity, are controlled or altered by vapor compression system 410. For example, if vapor compression system 410 was an air conditioning unit, then ambient surroundings 470 would be defined by the area within a building or house being cooled by the air conditioning unit. Moreover, if vapor compression system 410 was a refrigeration unit, for example, then ambient surroundings 470 would be the area within a freezer or a refrigerator being cooled by the refrigeration unit.

In one preferred embodiment, a sensor 460 is located in ambient surroundings 470 and measures the conditions of ambient surroundings 470. Sensor 460 is any metering device known to one of ordinary skill in the art that can measure the conditions of ambient surroundings 470, such as a pressure sensor, a temperature sensor, or a sensor that measures the density of the fluid. Sensor 460 relays information through a control line 481 to metering unit 449 and through a second control line 483 to XDX valve 418. In this way, sensor 460 is able to direct the heat transfer fluid to run either through XDX valve 418 or metering unit 449 based upon the conditions of ambient surroundings 470.

In one preferred embodiment, sensor 460 is located in ambient surroundings 470 and measures the humidity of ambient surroundings 470. A desired humidity level is programmed into sensor 460. Upon determining the humidity of ambient surroundings 470, sensor 460 then decides whether to direct the flow of heat transfer fluid to either XDX valve 418 or metering unit 449 based upon the desired humidity level programmed into sensor 460. If the desired humidity level is less than the actual humidity of the ambient surroundings 470, sensor 460 directs the flow of heat transfer fluid to flow through metering unit 449 by closing first inlet 461, and by opening inlet 464. By directing the heat transfer fluid to flow through metering unit 449, vapor compression system 410 operates in what will be referred to as a conventional refrigeration cycle. When vapor compression system 410 operates in a conventional refrigeration cycle, the amount of humidity in the ambient surroundings 470 is decreased. If the desired humidity level is greater than the actual humidity of the ambient surroundings 470, sensor 460 directs the flow of heat transfer fluid to flow through XDX valve 418 by opening first inlet 461, and by closing inlet 464. By directing the heat transfer fluid to flow through XDX valve 418, vapor compression system 410 operates in what will be referred to as an XDX cycle. When vapor compression system 410 operates in an XDX cycle, the amount of humidity in the ambient surroundings 470 increases.

In one preferred embodiment, gating valves 471 and 474 are located at first inlet 461 and inlet 464, respectively, as illustrated in FIG. 20. Preferably, gating valves 471 and 474 are solenoid valves capable of terminating the flow of heat transfer fluid through a passageway, such as liquid line 422, in response to an electrical signal. However, gating valves may be any valve capable of terminating the flow of heat transfer fluid through a passageway known to one of ordinary skill, such as a valve that is mechanically activated. Gating valves 471 and 474 can be used to open or close first inlet 461 and inlet 464 at any time either mechanically or in response to an electrical signal.

In one preferred embodiment, sensor 460 decides whether to direct the flow of heat transfer fluid to either XDX valve 418 or metering unit 449 based upon the temperature of the ambient surroundings 470. A desired temperature level for the ambient surroundings 470 must first be programmed into sensor 460. Sensor 460 directs the flow of heat transfer fluid to flow through metering unit 449 by closing first inlet 461 and by opening inlet 464. By directing the heat transfer fluid to flow through metering unit 449, vapor compression system 410 operates in what will be referred to as a conventional refrigeration cycle. When vapor compression system 410 operates in a conventional refrigeration cycle, the load capacity of vapor compression system 410 is decreased. If the desired temperature level cannot be reached after a predetermined time interval, then sensor 460 directs the flow of heat transfer fluid to flow through XDX valve 418 by opening first inlet 461 and by closing inlet 464. By directing the heat transfer fluid to flow through XDX valve 418, vapor compression system 410 operates in what will be referred to as an XDX cycle. When vapor compression system 410 operates in an XDX cycle, the load capacity of vapor compression system 410 is increased.

Varying the load capacity of vapor compression system 410 allows vapor compression system 410 to be more accurately sized for cooling ambient surroundings 470. For example, if ambient surroundings 470 needs to be cooled in a range which varies from an average amount of ° C. to a maximum amount of ° C., vapor compression system 410 must be sized to cool ambient surroundings 470 by at least the maximum amount of ° C. so that vapor compression system 410 can achieve the desired temperature level even when the difference between the temperature level of the ambient surroundings 470 and the desired temperature level is the maximum amount of ° C. However, this means that vapor compression system 410 must be sized larger than required, since more often than not vapor compression system 410 need only cool ambient surroundings by the average amount of ° C. However, by varying the load capacity of vapor compression system 410, as described above, vapor compression system 410 can be sized so that it cools ambient surroundings by the average amount of ° C. when operating vapor compression system 410 in a conventional refrigeration cycle, and up to the maximum amount of ° C. when operating vapor compression system 410 in an XDX cycle.

While the above use of sensor 460 to direct the flow of heat transfer fluid to either XDX valve 418 or metering unit 449 has been described as being in response to the humidity level or the temperature level of the ambient surroundings, sensor 460 may direct the flow of heat transfer fluid to either XDX valve 418 or metering unit 449 in response to any variable or condition. Moreover, while the above use of vapor compression system 410 has required a sensor 460 to direct the flow of heat transfer fluid to either XDX valve 418 or metering unit 449, the flow may be manually directed to either XDX valve 418 or metering unit 449, or directed to either XDX valve 418 or metering unit 449 in any one of a number of ways known to one of ordinary skill in the art, for any one of a number of reasons.

In one preferred embodiment, discharge line 420 is coupled to both second inlet 462 of XDX valve 418 and condenser 414, to facilitate the defrosting of evaporator 416. Preferably, discharge line 420 is bifurcated so as to allow discharge line 420 to be simultaneously coupled to both second inlet 462 of XDX valve 418 and condenser 414, as illustrated in FIG. 20. Gating valve 472 is located at second inlet 462 so as to control the flow of heat transfer fluid from compressor 412 to second inlet 462. In order to defrost the coils of evaporator 416, gating valves 472 is opened, and gating valves 471 and 474 are closed to allow heat transfer fluid from compressor 412 to enter evaporator 416 and defrost evaporator 416.

Figure 22:
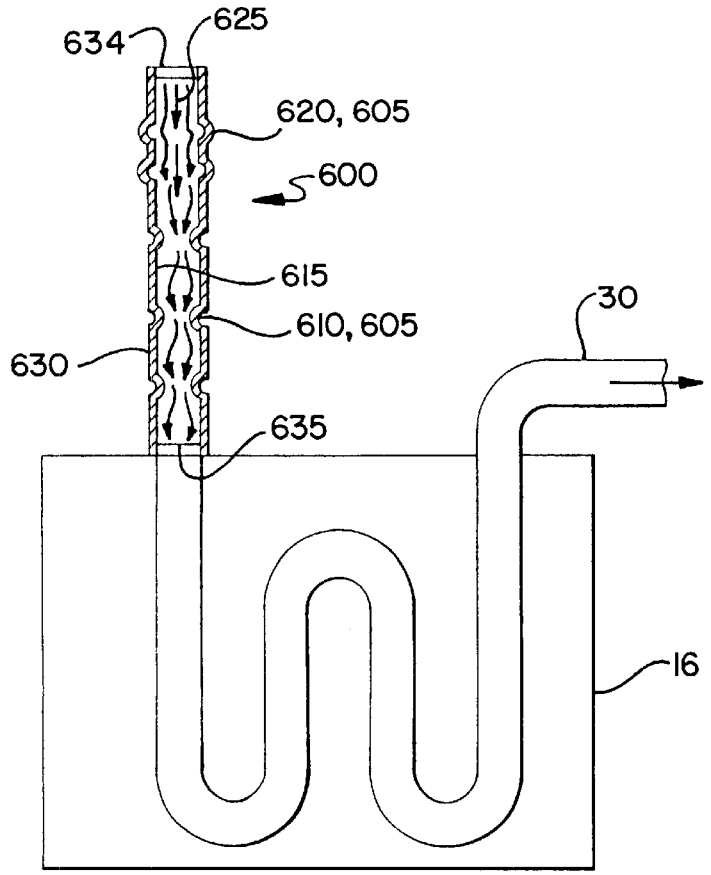
FIG. 22 is an enlarged cross-sectional view of a portion of the vapor compression in accordance with another embodiment of the invention

In one preferred embodiment, vapor compression system 10 includes a turbulent line 600 before the inlet of evaporator 16, as illustrated in FIG. 22. Turbulent line 600 includes an inlet 634, an outlet 635, and a passageway 630 connecting inlet 634 to outlet 635. Turbulent line 600 also includes dimples 605 located on the interior surface 615 of passageway 630 of turbulent line 600. Dimples 605 convert the flow of heat transfer fluid from a laminar flow to a turbulent flow. By converting heat transfer fluid to a turbulent flow before heat transfer fluid enters evaporator 16, the efficiency of evaporator 16 is increased. Dimples 605 may either be ridges 610 which project inwards towards the flow 625 of the heat transfer fluid or bumps 620 which project outwards and away from the flow 625 of heat transfer fluid, as illustrated in FIG. 22.

Preferably, turbulent line 600 is position between the metering unit, such as multifunctional valve 18, 90, 94, 110 or 225, recovery valve 19, XDX valve 418, or any conventional metering unit used to meter the flow of heat transfer fluid upon entering evaporator. The placement, size, and spacing of ridges 610 to create a turbulent flow depends on the diameter and length of turbulent line 600 along with the flow rate of the heat transfer fluid and the type of heat transfer fluid being used, all which are factors that can be determined by one of ordinary skill in the art. In one preferred embodiment, the line connecting the metering unit to the inlet of evaporator 16, referred to herein as either the saturated vapor line or the refrigerant line, includes turbulent line 600. Preferably, a portion of saturated vapor line or refrigerant line includes turbulent line 600.

Figure 23:
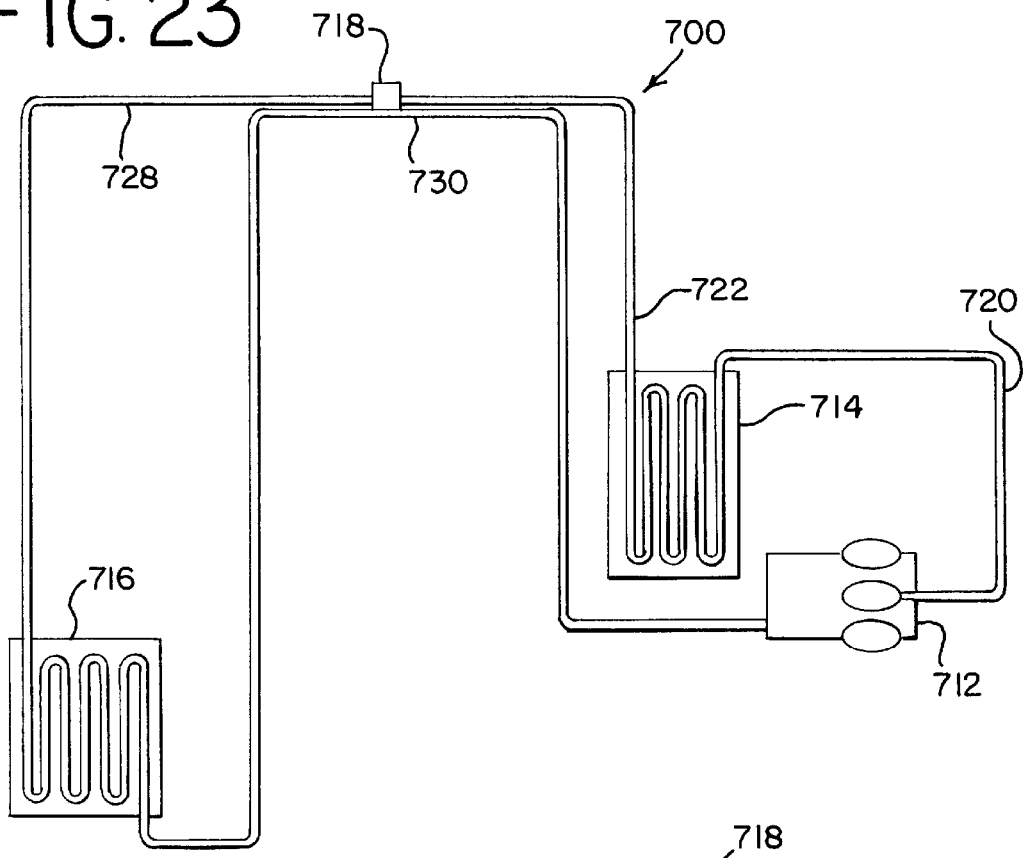
FIG. 23 is a schematic drawing of a vapor-compression system arranged in accordance with another embodiment of the invention.

One embodiment of a vapor compression system 700 is illustrated in FIG. 23. Vapor compression system 700 includes a compressor 712 for increasing the pressure and temperature of heat transfer fluid, a condenser 714 for liquefying heat transfer fluid, an evaporator 716 for transferring heat from ambient surroundings to heat transfer fluid, and an expansion valve 718 for expanding the heat transfer fluid. Vapor compression system 700 also includes discharge line 720, liquid line 722, saturated vapor line 728, and suction line 730, for flowing heat transfer fluid from one component of vapor compression system 700, such as compressor 712, condenser 714, evaporator 716, and expansion valve 718, to another component of vapor compression system 700. Compressor 712 is connected with condenser 714 through discharge line 720, condenser 714 is connected with expansion valve 718 through liquid line 722, expansion valve 718 is connected with evaporator 716 through saturated vapor line 728, and evaporator 716 is connected with compressor 712 through suction line 730, as illustrated in FIG. 23.

Expansion valve 718 includes an expansion device 721 for expanding the heat transfer fluid and an internal sensor 732 for detecting conditions in the heat transfer fluid. In one embodiment, internal sensor 732 detects conditions in and around suction line 730. Expansion device 718 is any device known to one of ordinary skill in the art that can be used to meter the flow of heat transfer fluid, such as XDX valve 418, multifunctional valves 18, 90, 94, 110 and 225, recovery valve 19, as described herein, any metering unit coupled to a relatively short liquid line and a relatively long saturated vapor line sufficient in length and diameter to vaporize a portion of the heat transfer fluid before the heat transfer fluid enters the evaporator, as described herein, and any metering unit in which a heat source is applied to the heat transfer fluid in the saturated vapor line sufficient to vaporize a portion of the heat transfer fluid before the heat transfer fluid enters the evaporator, as described herein, a thermostatic expansion valve, a capillary tube, a fast-action capillary tube 500, and a pressure control.

Internal sensor 732 is operably connected to expansion device 721. Internal sensor 32 can be any type of sensor known by those skilled in the art designed to detect conditions in and around vapor compression system 700, such as the temperature, pressure, enthalpy, and moisture of heat transfer fluid or any other type of conditions that may be monitored in and around vapor compression other type of conditions that may be monitored in and around vapor compression system 700. Internal Sensor 732 can be used to vary the rate in which a heat transfer fluid is volumetrically expanded through expansion device 718. Preferably, internal sensor 732 varies the rate in which a heat transfer fluid is volumetrically expanded through expansion device 718 in response to conditions in or around suction line 730.

Figure 24:
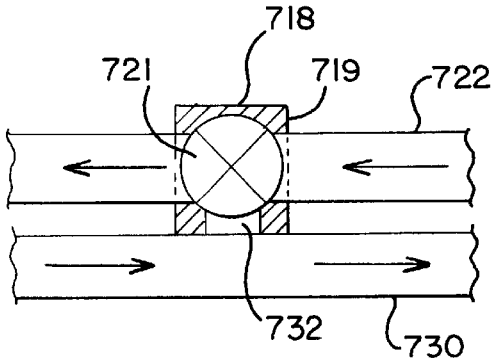
FIG. 24 is an enlarged schematic drawing of a portion of the vapor-compression system shown in FIG. 23.

In one embodiment, a portion of sensor 732 is exposed through or on a surface of expansion valve 718, as illustrated in FIG. 24, and expansion valve 18 is mounted to a portion of suction line 730 so that sensor can detect conditions in and around suction line 730. In one embodiment, a portion of the heat transfer fluid 34 flowing through suction line 730 is diverted to flow through a bypass line 734. Heat transfer fluid in bypass line 734 flows through expansion valve 718, whereupon sensor 732 detects the conditions of heat transfer fluid, as illustrated in FIG. 25.

Figure 25:
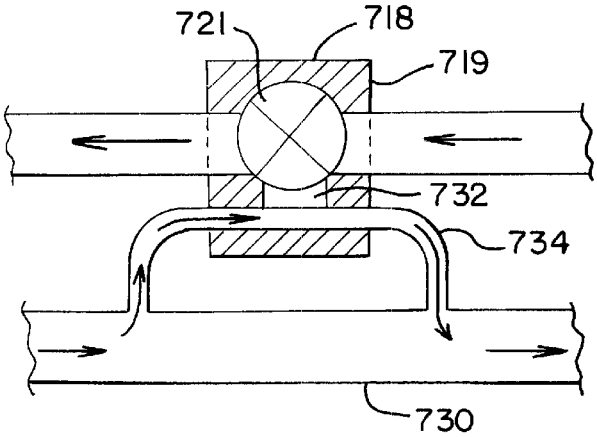
FIG. 25 is an enlarged schematic drawing of a portion of a vapor-compression system, in accordance with another embodiment of the invention.

Preferably, portions of expansion device 721 and internal sensor 732 are surrounded by and housed within a housing 719, as illustrated in FIGS. 24–25. By including portions of both expansion device 721 and sensor 732 within a single housing or by making portions of both expansion device 721 and sensor 732 parts of a expansion valve 718, the cost of manufacturing vapor compression system 700 can be reduced when compared with the cost of a vapor compression system having an expansion valve with an external sensor. As known by one of ordinary skill in the art, every element of vapor compression system 10 described above, such as evaporator 16, liquid line 22, and suction line 30, can be scaled and sized to meet a variety of load requirements. In addition, the refrigerant charge of the heat transfer fluid in vapor compression system 10, may be equal to or greater than the refrigerant charge of a conventional system.

Without further elaboration it is believed that one skilled in the art can, using the preceding description, utilize the invention to its fullest extent. The following examples are merely illustrative of the invention and are not meant to limit the scope in any way whatsoever.

EXAMPLE I

A 5-ft (1.52 m) Tyler Chest Freezer was equipped with a multifunctional valve in a refrigeration circuit, and a standard expansion valve was plumbed into a bypass line so that the refrigeration circuit could be operated as a conventional vapor compression system and as an XDX refrigeration system arranged in accordance with the invention. The refrigeration circuit described above was equipped with a saturated vapor line having an outside tube diameter of about 0.375 inches (0.953 cm) and an effective tube length of about 10 ft (3.048 m). The refrigeration circuit was powered by a Copeland hermetic compressor having a capacity of about ⅓ ton (338 kg) of refrigeration. A sensing bulb was attached to the suction line about 18 inches from the compressor. The circuit was charged with about 28 oz.

(792 g) of R-12 refrigerant available from The DuPont Company. The refrigeration circuit was also equipped with a bypass line extending from the compressor discharge line to the saturated vapor line for forward-flow defrosting (See FIG. 1). All refrigerated ambient air temperature measurements were made using a "CPS Date Logger" by CPS temperature sensor located in the center of the refrigeration case, about 4 inches (10 cm) above the floor.

XDX System—Medium Temperature Operation

The nominal operating temperature of the evaporator was 20° F. (−6.7° C.) and the nominal operating temperature of the condenser was 120° F. (48.9° C.). The evaporator handled a cooling load of about 3000 Btu/hr (21 g cal/s). The multifunctional valve metered refrigerant into the saturated vapor line at a temperature of about 20° F. (−6.7° C.). The sensing bulb was set to maintain about 25° F. (13.9° C.) superheating of the vapor flowing in the suction line. The compressor discharged pressurized refrigerant into the discharge line at a condensing temperature of about 120° F. (48.9° C.), and a pressure of about 172 lbs/in$^2$ (118,560 N/m$^2$).

XDX System—Low Temperature Operation

The nominal operating temperature of the evaporator was −5° F. (−20.5° C.) and the nominal operating temperature of the condenser was 115° F. (46.1° C.). The evaporator handled a cooling load of about 3000 Btu/hr (21 g cal/s). The multifunctional valve metered about 2975 ft/min (907 km/min) of refrigerant into the saturated vapor line at a temperature of about −5° F. (−20.5° C). The sensing bulb was set to maintain about 20° F. (11.1° C.) superheating of the vapor flowing in the suction line. The compressor discharged about 2299 ft/min (701 m/min) of pressurized refrigerant into the discharge line at a condensing temperature of about 115° F. (46.1° C.), and a pressure of about 161 lbs/in$^2$ (110,977 N/m$^2$). The XDX system was operated substantially the same in low temperature operation as in medium temperature operation with the exception that the fans in the Tyler Chest Freezer were delayed for 4 minutes following defrost to remove heat from the evaporator coil and to allow water drainage from the coil.

The XDX refrigeration system was operated for a period of about 24 hours at medium temperature operation and about 18 hours at low temperature operation. The temperature of the ambient air within the Tyler Chest Freezer was measured about every minute during the 23 hour testing period. The air temperature was measured continuously during the testing period, while the vapor compression system was operated in both refrigeration mode and in defrost mode. During defrost cycles, the refrigeration circuit was operated in defrost mode until the sensing bulb temperature reached about 50° F. (10° C.). The temperature measurement statistics appear in Table I below.

Conventional System—Medium Temperature Operation With Electric Defrost

The Tyler Chest Freezer described above was equipped with a bypass line extending between the compressor discharge line and the suction line for defrosting. The bypass line was equipped with a solenoid valve to gate the flow of high temperature refrigerant in the line. An electric heat element was energized instead of the solenoid during this test. A standard expansion valve was installed immediately adjacent to the evaporator inlet and the temperature sensing bulb was attached to the suction line immediately adjacent to the evaporator outlet. The sensing bulb was set to maintain about 6° F. (3.33° C.) superheating of the vapor flowing in the suction line. Prior to operation, the vapor compression system was charged with about 48 oz. (1.36 kg) of R-12 refrigerant.

The conventional vapor compression system was operated for a period of about 24 hours at medium temperature operation. The temperature of the ambient air within the Tyler Chest Freezer was measured about every minute during the 24 hour testing period. The air temperature was measured continuously during the testing period, while the vapor compression system was operated in both refrigeration mode and in reverse-flow defrost mode. During defrost cycles, the refrigeration circuit was operated in defrost mode until the sensing bulb temperature reached about 50° F. (10° C.). The temperature measurement statistics appear in Table I below.

Conventional System—Medium Temperature Operation With Air Defrost

The Tyler Chest Freezer described above was equipped with a receiver to provide proper liquid supply to the expansion valve and a liquid line dryer was installed to allow for additional refrigerant reserve. The expansion valve and the sensing bulb were positioned at the same locations as in the reverse-flow defrost system described above. The sensing bulb was set to maintain about 8° F. (4.4° C.) superheating of the vapor flowing in the suction line. Prior to operation, the vapor compression system was charged with about 34 oz. (0.966 kg) of R-12 refrigerant.

The conventional vapor compression system was operated for a period of about 24½ hours at medium temperature operation. The temperature of the ambient air within the Tyler Chest Freezer was measured about every minute during the 24½ hour testing period. The air temperature was measured continuously during the testing period, while the vapor compression system was operated in both refrigeration mode and in air defrost mode. In accordance with conventional practice, four defrost cycles were programmed with each lasting for about 36 to 40 minutes. The temperature measurement statistics appear in Table I below.

TABLE I

REFRIGERATION TEMPERATURES (° F./° C.)

| | XDX[1] Medium Temperature | XDX[1] Low Temperature | Conventional[2] Electric Defrost | Conventional[2] Air Defrost |
|---|---|---|---|---|
| Average | 38.7/3.7 | 4.7/−15.2 | 39.7/4.3 | 39.6/4.2 |
| Standard Deviation | 0.8 | 0.8 | 4.1 | 4.5 |
| Variance | 0.7 | 0.6 | 16.9 | 20.4 |
| Range | 7.1 | 7.1 | 22.9 | 26.0 |

[1]one defrost cycle during 23 hour test period
[2]three defrost cycles during 24 hour test period As illustrated above, the XDX refrigeration system arranged in accordance with the invention maintains a desired the temperature within the chest freezer with less temperature variation than the conventional systems. The standard deviation, the variance, and the range of the temperature measurements taken during the testing period are substantially less than the conventional systems. This result holds for operation of the XDX system at both medium and low temperatures.

During defrost cycles, the temperature rise in the chest freezer was monitored to determine the maximum temperature within the freezer. This temperature should be as close to the operating refrigeration temperature as possible to avoid spoilage of food products stored in the freezer. The maximum defrost temperature for the XDX system and for the conventional systems is shown in Table II below.

TABLE II

| MAXIMUM DEFROST TEMPERATURE (° F./° C.) | | |
|---|---|---|
| XDX Medium Temperature | Conventional Electric Defrost | Conventional Air Defrost |
| 44.4/6.9 | 55.0/12.8 | 58.4/14.7 |

EXAMPLE II

The Tyler Chest Freezer was configured as described above and further equipped with electric defrosting circuits. The low temperature operating test was carried out as described above and the time needed for the refrigeration unit to return to refrigeration operating temperature was measured. A separate test was then carried out using the electric defrosting circuit to defrost the evaporator. The time needed for the XDX system and an electric defrost system to complete defrost and to return to the 5° F. (−15° C.) operating set point appears in Table III below.

TABLE III

| TIME NEEDED TO RETURN TO REFRIGERATION TEMPERATURE OF 5° F. (−15° C.) FOLLOWING | | |
|---|---|---|
| | XDX | Conventional System with Electric Defrost |
| Defrost Duration (min) | 10 | 36 |
| Recovery Time (min) | 24 | 144 |

As shown above, the XDX system using forward-flow defrost through the multifunctional valve needs less time to completely defrost the evaporator, and substantially less time to return to refrigeration temperature.

Thus, it is apparent that there has been provided, in accordance with the invention, a vapor compression system that fully provides the advantages set forth above. Although the invention has been described and illustrated with reference to specific illustrative embodiments thereof, it is not intended that the invention be limited to those illustrative embodiments. Those skilled in the art will recognize that variations and modifications can be made without departing from the spirit of the invention. For example, non-halogenated refrigerants can be used, such as ammonia, and the like can also be used. It is therefore intended to include within the invention all such variations and modifications that fall within the scope of the appended claims and equivalents thereof.

What is claimed is:

1. A vapor compression system comprising:

a compressor;

a condenser connected with the compressor through a discharge line;

an evaporator connected with the compressor through a suction line;

an expansion valve connected with the evaporator through a saturated vapor line and connected with the condenser through a liquid line, the expansion valve comprising: an expansion device; and an internal sensor for detecting conditions within a heat transfer fluid, wherein the suction line is connected with a bypass line, and wherein the bypass line flows through the expansion valve.

2. The vapor compression system of claim 1, wherein the suction line is adjacent to the expansion valve, and wherein a portion of the internal sensor is connected with the suction line.

3. The vapor compression system of claim 1, wherein the bypass line is adjacent the internal sensor.

4. The vapor compression system of claim 1, wherein the expansion valve further comprises a housing, and wherein the housing surrounds at least a portion of the expansion device and the internal sensor.

5. The vapor compression system of claim 4, wherein the housing encloses both the expansion device and the internal sensor.

6. The vapor compression system of claim 1, wherein the internal sensor varies the rate in which the heat transfer fluid is volumetrically expanded through the expansion device in response to conditions in the suction line.

* * * * *

UNITED STATES PATENT AND TRADEMARK OFFICE

CERTIFICATE OF CORRECTION

PATENT NO. : 6,393,851 B1
DATED : May 28, 2002
INVENTOR(S) : David A. Wightman

It is certified that error appears in the above-identified patent and that said Letters Patent is hereby corrected as shown below:

Title page,
Item [56], References Cited, FOREIGN PATENT DOCUMENTS, delete "4,813,100" and substitute -- 4,813,474 -- in its place.

Signed and Sealed this

Twenty-fifth Day of May, 2004

JON W. DUDAS
*Acting Director of the United States Patent and Trademark Office*